US009260869B2

(12) United States Patent
Palsson et al.

(10) Patent No.: US 9,260,869 B2
(45) **Date of Patent: *Feb. 16, 2016**

(54) BUILDING PANELS

(71) Applicant: PERGO (EUROPE) AB, Trelleborg (SE)

(72) Inventors: Jorgen Palsson, Landskrona (SE); Ake Sjoberg, Lund (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/098,187

(22) Filed: Dec. 5, 2013

(65) Prior Publication Data

US 2014/0165493 A1 Jun. 19, 2014

Related U.S. Application Data

(63) Continuation of application No. 13/860,315, filed on Apr. 10, 2013, which is a continuation of application No. 13/437,597, filed on Apr. 2, 2012, now Pat. No. 8,544,233, which is a continuation of application No.

(Continued)

(30) Foreign Application Priority Data

Mar. 31, 2000 (SE) ..... 0001149

(51) Int. Cl.

| | |
|---|---|
| ***E04B 2/00*** | (2006.01) |
| ***E04F 15/02*** | (2006.01) |
| *E04F 15/04* | (2006.01) |

(52) U.S. Cl.

CPC ..... *E04F 15/02038* (2013.01); *E04F 15/02* (2013.01); *E04F 15/04* (2013.01);

(Continued)

(58) Field of Classification Search

CPC ..... E04F 15/02; E04F 15/02038; E04F 15/04; E04F 2201/05

USPC ..... 52/588.1, 581, 589.1, 592.2

See application file for complete search history.

(56) References Cited

U.S. PATENT DOCUMENTS

| | | | |
|---|---|---|---|
| 87,653 | A | 3/1869 | Kappes |
| 108,068 | A | 10/1870 | Utley |

(Continued)

FOREIGN PATENT DOCUMENTS

| | | | |
|---|---|---|---|
| AT | 000 112 | U2 | 2/1995 |
| AU | 1309883 | A | 10/1983 |

(Continued)

OTHER PUBLICATIONS

Daiken Trade & Ind Co Ltd, Patent Abstract of Japan, Publication No. 07300979, Nov. 14, 1995.*

(Continued)

*Primary Examiner* — Basil Katcheves

(74) *Attorney, Agent, or Firm* — Jenkins, Wilson, Taylor & Hunt, P.A.

(57) ABSTRACT

Flooring material comprising sheet-shaped floor elements with a mainly square or rectangular shape. The floor elements are provided with edges, a lower side and an upper decorative layer. The floor elements are intended to be joined by means of joining members. The floor elements are provided with male joining members on a first edge while a second edge of the floor elements are provided with a female joining member. The male joining member is provided with a tongue and a lower side groove while the female joining member is provided with a groove and a cheek, the cheek being provided with a lip. The floor elements are provided with a male vertical assembly joining member on a third edge while a fourth, opposite, edge is provided with female vertical assembly joining member.

8 Claims, 6 Drawing Sheets

Related U.S. Application Data

12/240,739, filed on Sep. 29, 2008, now Pat. No. 8,146,318, which is a continuation of application No. 11/540,583, filed on Oct. 2, 2006, now Pat. No. 7,441, 385, and a continuation-in-part of application No. 09/988,014, filed on Nov. 16, 2001, now abandoned, and a continuation-in-part of application No. 09/672, 076, filed on Sep. 29, 2000, now Pat. No. 6,591,568.

(52) U.S. Cl.

CPC . *E04F2201/0115* (2013.01); *E04F 2201/0138* (2013.01); *E04F 2201/0153* (2013.01); *E04F 2201/023* (2013.01); *E04F 2201/026* (2013.01); *E04F 2201/05* (2013.01); *E04F 2201/0517* (2013.01); *E04F 2201/0523* (2013.01)

(56) References Cited

U.S. PATENT DOCUMENTS

| | | | | |
|---|---|---|---|---|
| 208,036 | A | | 9/1878 | Robley |
| 213,740 | A | | 4/1879 | Conner |
| 274,354 | A | | 3/1883 | McCarthy et al. |
| 308,313 | A | | 11/1884 | Gerike |
| 338,653 | A | | 5/1886 | Whitmore |
| 342,529 | A | | 5/1886 | McRae |
| 502,289 | A | | 8/1893 | Feldman |
| 662,458 | A | | 11/1900 | Nagel |
| 713,577 | A | | 11/1902 | Wickham |
| 714,987 | A | | 12/1902 | Wolfe |
| 752,694 | A | | 2/1904 | Lund |
| 753,791 | A | | 3/1904 | Fulghum |
| 769,355 | A | | 9/1904 | Platow |
| 832,003 | A | | 9/1906 | Torrence |
| 847,272 | A | | 3/1907 | Ayers |
| 877,639 | A | | 1/1908 | Galbraith |
| 890,436 | A | | 6/1908 | Momberg |
| 898,381 | A | | 9/1908 | Mattison |
| 1,000,859 | A | | 8/1911 | Vaughan |
| 1,002,102 | A | | 8/1911 | Weedon |
| 1,016,383 | A | | 2/1912 | Wellman |
| 1,078,776 | A | | 11/1913 | Dunton |
| 1,097,986 | A | | 5/1914 | Moritz |
| 1,124,226 | A | | 1/1915 | Houston |
| 1,124,228 | A | | 1/1915 | Houston |
| 1,137,197 | A | | 4/1915 | Ellis |
| 1,140,958 | A | | 5/1915 | Cowan |
| 1,201,285 | A | | 10/1916 | Gray |
| 1,266,253 | A | | 5/1918 | Hakason |
| 1,319,286 | A | | 10/1919 | Johnson et al. |
| 1,357,713 | A | | 11/1920 | Lane |
| 1,371,856 | A | | 3/1921 | Cade |
| 1,407,679 | A | | 2/1922 | Ruchrauff |
| 1,411,415 | A | | 4/1922 | Cooley |
| 1,436,858 | A | | 11/1922 | Reinhart |
| 1,454,250 | A | | 5/1923 | Parsons |
| 1,468,288 | A | | 9/1923 | Fen |
| 1,510,924 | A | | 10/1924 | Daniels et al. |
| 1,540,128 | A | | 6/1925 | Houston |
| 1,575,821 | A | | 3/1926 | Daniels |
| 1,576,527 | A | | 3/1926 | McBride |
| 1,576,821 | A | | 3/1926 | Daniels |
| 1,602,256 | A | | 10/1926 | Sellin |
| 1,602,267 | A | | 10/1926 | Karwisde |
| 1,615,096 | A | | 1/1927 | Myers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,657,159 | A | | 1/1928 | Greenebaum |
| 1,660,480 | A | | 2/1928 | Daniels |
| 1,706,924 | A | | 3/1929 | Kane |
| 1,714,738 | A | | 5/1929 | Smith |
| 1,718,702 | A | | 6/1929 | Pfiester |
| 1,723,306 | A | | 8/1929 | Sipe |
| 1,734,826 | A | | 11/1929 | Pick |
| 1,736,539 | A | | 11/1929 | Lachman |
| 1,743,492 | A | | 1/1930 | Sipe |
| 1,764,331 | A | | 6/1930 | Moratz |
| 1,772,417 | A | | 8/1930 | Ellinwood |
| 1,776,188 | A | | 9/1930 | Langbaum |
| 1,823,039 | A | | 9/1930 | Gruner |
| 1,778,069 | A | | 10/1930 | Fetz |
| 1,787,027 | A | | 12/1930 | Wasleff |
| 1,801,093 | A | | 4/1931 | Larkins |
| 1,843,024 | A | | 1/1932 | Werner |
| 1,854,396 | A | | 4/1932 | Davis |
| 1,859,667 | A | | 5/1932 | Gruner |
| 1,864,774 | A | | 6/1932 | Storm |
| 1,477,813 | A | | 12/1932 | Daniels et al. |
| 1,898,364 | A | | 2/1933 | Gynn |
| 1,906,411 | A | | 5/1933 | Potvin |
| 1,913,342 | A | | 6/1933 | Schaffert |
| 1,929,871 | A | | 10/1933 | Jones |
| 1,940,377 | A | | 12/1933 | Storm |
| 1,953,306 | A | | 4/1934 | Moratz |
| 1,966,020 | A | | 7/1934 | Rowley |
| 1,978,075 | A | | 10/1934 | Butterworth |
| 1,986,739 | A | | 1/1935 | Mitte |
| 1,988,201 | A | | 1/1935 | Hall |
| 1,991,701 | A | | 2/1935 | Roman |
| 2,004,193 | A | | 6/1935 | Cherry |
| 2,015,813 | A | | 10/1935 | Nielsen |
| 2,027,292 | A | | 1/1936 | Rockwell |
| 2,044,216 | A | | 6/1936 | Klages |
| 2,045,067 | A | * | 6/1936 | Bruce ..... 52/747.1 |
| 2,049,571 | A | | 8/1936 | Schuck |
| 2,088,405 | A | | 7/1937 | Cahn |
| 2,100,238 | A | | 11/1937 | Burgess |
| RE20,816 | E | | 8/1938 | Haase |
| 2,126,956 | A | | 8/1938 | Gilbert |
| 2,138,085 | A | | 11/1938 | Birtles |
| 2,141,708 | A | | 12/1938 | Elmendorf |
| 2,142,305 | A | | 1/1939 | Davis |
| 2,194,086 | A | | 3/1940 | Horn |
| 2,199,938 | A | | 5/1940 | Kloote |
| 2,222,137 | A | * | 11/1940 | Bruce ..... 52/364 |
| 2,226,540 | A | | 12/1940 | Boettcher |
| 2,238,169 | A | | 4/1941 | Heyn et al. |
| 2,245,497 | A | | 6/1941 | Potchen |
| 2,253,943 | A | | 8/1941 | Rice |
| 2,261,897 | A | | 11/1941 | Adams |
| 2,263,930 | A | | 11/1941 | Pasquier |
| 2,266,464 | A | | 12/1941 | Kraft |
| 2,276,071 | A | * | 3/1942 | Scull ..... 52/591.4 |
| 2,280,071 | A | | 4/1942 | Hamilton |
| 2,282,559 | A | | 5/1942 | Byers |
| 2,324,628 | A | | 7/1943 | Kahr |
| 2,360,933 | A | | 10/1944 | Bunker |
| 2,363,429 | A | | 11/1944 | Lowry |
| 2,381,469 | A | | 8/1945 | Sweet |
| 2,398,632 | A | | 4/1946 | Frost et al. |
| 2,405,602 | A | | 8/1946 | Nugent |
| 2,430,200 | A | * | 11/1947 | Wilson ..... 52/588.1 |
| 2,441,364 | A | | 5/1948 | Maynard |
| 2,487,571 | A | | 11/1949 | Maxwell |
| 2,491,498 | A | | 12/1949 | Kahr |
| 2,534,501 | A | | 12/1950 | Coleman |
| 2,644,552 | A | | 7/1953 | MacDonanld |
| 2,717,420 | A | | 9/1955 | Georges |
| 2,729,584 | A | | 1/1956 | Foster |
| 2,740,167 | A | | 4/1956 | Rowley |
| 2,780,253 | A | | 2/1957 | Joa |
| 2,805,852 | A | | 9/1957 | Ewert |
| 2,808,624 | A | | 10/1957 | Sullivan |
| 2,823,433 | A | | 2/1958 | Kendall |
| 2,839,790 | A | | 6/1958 | Collings |
| 2,857,302 | A | | 10/1958 | Burton et al. |
| 2,863,185 | A | | 12/1958 | Reidi |
| 2,865,058 | A | | 12/1958 | Ake Andersson et al. |
| 2,875,117 | A | | 2/1959 | Potchen et al. |
| 2,878,530 | A | | 3/1959 | Hilding |
| 2,894,292 | A | | 7/1959 | Gramelspacher |
| 2,914,815 | A | | 12/1959 | Alexander |
| 2,926,401 | A | | 3/1960 | Place |

(56) References Cited

U.S. PATENT DOCUMENTS

| | | | |
|---|---|---|---|
| 2,947,040 | A | 8/1960 | Schultz |
| 2,831,223 | A | 9/1960 | DeShazor |
| 2,952,341 | A | 9/1960 | Weiler |
| 2,974,692 | A | 3/1961 | Bolenbach |
| 2,996,751 | A | 8/1961 | Roby |
| 3,039,575 | A | 6/1962 | Graham |
| 3,040,388 | A | 6/1962 | Conn |
| 3,045,294 | A | 7/1962 | Livezy, Jr. |
| 3,090,082 | A | 5/1963 | Bauman |
| 3,100,556 | A | 8/1963 | Ridder |
| 3,125,138 | A | 3/1964 | Bolenbach |
| 3,128,851 | A | 4/1964 | Deridder et al. |
| 3,141,392 | A | 7/1964 | Schneider |
| 3,145,503 | A | 8/1964 | Brechin |
| 3,148,482 | A | 9/1964 | Neale |
| 3,162,906 | A | 12/1964 | Dudley |
| 3,172,508 | A | 3/1965 | Doering et al. |
| 3,174,411 | A | 3/1965 | Oestrich et al. |
| 3,175,476 | A | 3/1965 | Franks |
| 3,182,769 | A | 5/1965 | De Ridder |
| 3,192,574 | A | 7/1965 | Jaffe et al. |
| 3,199,258 | A | 8/1965 | Jentoft et al. |
| 3,200,553 | A | 8/1965 | Frashour et al. |
| 3,203,149 | A | 8/1965 | Soddy |
| 3,204,380 | A | 9/1965 | Wilson |
| 3,205,633 | A | 9/1965 | Nusbaum |
| 3,253,377 | A | 5/1966 | Schakel |
| 3,257,225 | A | 6/1966 | Marotta |
| 3,267,630 | A | 8/1966 | Omholt |
| 3,282,010 | A | 11/1966 | King, Jr. |
| 3,286,425 | A | 11/1966 | Brown |
| 3,296,056 | A | 1/1967 | Bechtold |
| 3,301,147 | A | 1/1967 | Aluminum |
| 3,310,919 | A | 3/1967 | Bue |
| 3,313,072 | A | 4/1967 | Cue |
| 3,331,171 | A | 7/1967 | Hallock |
| 3,331,176 | A | 7/1967 | Washam |
| 3,332,192 | A | 7/1967 | Kessler et al. |
| 3,339,329 | A | 9/1967 | Berg |
| 3,347,048 | A | 10/1967 | Brown et al. |
| 3,362,127 | A | 1/1968 | McGowan |
| 3,363,381 | A | 1/1968 | Forrest |
| 3,363,382 | A | 1/1968 | Forrest |
| 3,363,383 | A | 1/1968 | La Barge |
| 3,373,071 | A | 3/1968 | Fuerst |
| 3,377,931 | A | 4/1968 | Hilton |
| 3,385,182 | A | 5/1968 | Harvey |
| 3,387,422 | A | 6/1968 | Wanzer |
| 3,397,496 | A | 8/1968 | Sohns |
| 3,444,660 | A | 5/1969 | Feichter |
| 3,449,879 | A | 6/1969 | Bloom |
| 3,460,304 | A | 8/1969 | Braeuninger et al. |
| 3,473,278 | A | 10/1969 | Gossen |
| 3,474,584 | A | 10/1969 | Lynch |
| 3,479,784 | A | 11/1969 | Massagli |
| 3,481,810 | A | 12/1969 | Waite |
| 3,488,828 | A | 1/1970 | Gallagher |
| 3,496,119 | A | 2/1970 | Fitzgerald |
| 3,508,369 | A | 4/1970 | Tennison |
| 3,512,324 | A | 5/1970 | Reed |
| 3,526,420 | A | 9/1970 | Brancaleone |
| 3,535,844 | A | 10/1970 | Glaros |
| 3,538,665 | A | 11/1970 | Gohner |
| 3,538,819 | A | 11/1970 | Gould et al. |
| 3,548,559 | A | 12/1970 | Levine |
| 3,553,919 | A | 1/1971 | Omholt |
| 3,555,761 | A | 1/1971 | Rosebrough |
| 3,555,762 | A | 1/1971 | Costanzo, Jr. |
| 3,570,205 | A | 3/1971 | Payne |
| 3,572,224 | A | 3/1971 | Perry |
| 3,579,941 | A | 5/1971 | Tibbals |
| 3,605,368 | A | 9/1971 | Lalouche |
| 3,619,964 | A | 11/1971 | Passaro et al. |
| 3,627,362 | A | 12/1971 | Brenneman |
| 3,640,191 | A | 2/1972 | Hendrich |
| 3,657,852 | A | 4/1972 | Worthington et al. |
| 3,665,666 | A | 5/1972 | Delcroix |
| 3,667,153 | A | 6/1972 | Christiansen |
| 3,671,369 | A | 6/1972 | Kvalheim et al. |
| 3,673,751 | A | 7/1972 | Boassy et al. |
| 3,676,971 | A | 7/1972 | Dombroski |
| 3,679,531 | A | 7/1972 | Wienand et al. |
| 3,687,773 | A | 8/1972 | Wangborg |
| 3,694,983 | A | 10/1972 | Couquet |
| 3,696,575 | A | 10/1972 | Armstrong |
| 3,707,061 | A | 12/1972 | Collette et al. |
| 3,714,747 | A | 2/1973 | Curran |
| 3,720,027 | A | 3/1973 | Christensen |
| 3,731,445 | A | 5/1973 | Hoffmann et al. |
| 3,740,914 | A | 6/1973 | Arnaiz Diez |
| 3,742,672 | A | 7/1973 | Schaeufele |
| 3,745,726 | A | 7/1973 | Thom |
| 3,758,650 | A | 9/1973 | Hurst |
| 3,759,007 | A | 9/1973 | Thiele |
| 3,760,544 | A | 9/1973 | Hawes et al. |
| 3,760,548 | A | 9/1973 | Sauer et al. |
| 3,761,338 | A | 9/1973 | Ungar et al. |
| 3,768,846 | A | 10/1973 | Hensley et al. |
| 3,778,958 | A | 12/1973 | Fowler |
| 3,780,469 | A | 12/1973 | Hancovsky |
| 3,786,608 | A | 1/1974 | Boettcher |
| 3,798,111 | A | 3/1974 | Lane et al. |
| 3,807,113 | A | 4/1974 | Turner |
| 3,808,030 | A | 4/1974 | Bell |
| 3,810,707 | A | 5/1974 | Tungseth et al. |
| 3,849,111 | A | 11/1974 | Kihlstedt |
| 3,849,240 | A | 11/1974 | Mikulak |
| 3,859,000 | A | 1/1975 | Webster |
| 3,884,008 | A | 5/1975 | Miller |
| 3,884,328 | A | 5/1975 | Williams |
| 3,902,291 | A | 9/1975 | Zucht |
| 3,902,293 | A | 9/1975 | Witt et al. |
| 3,908,053 | A | 9/1975 | Hettich |
| 3,908,062 | A | 9/1975 | Roberts |
| 3,921,312 | A | 11/1975 | Fuller |
| 3,924,496 | A | 12/1975 | DerMarderosian et al. |
| 3,936,551 | A | 2/1976 | Elmendorf et al. |
| 3,953,661 | A | 4/1976 | Gulley |
| 3,987,599 | A | 10/1976 | Hines |
| 3,988,187 | A | 10/1976 | Witt et al. |
| 4,021,087 | A | 5/1977 | Ferguson |
| 4,037,377 | A | 7/1977 | Howell et al. |
| 4,059,933 | A | 11/1977 | Funk et al. |
| 4,060,437 | A | 11/1977 | Strout |
| 4,065,902 | A | 1/1978 | Lindal |
| 4,067,155 | A | 1/1978 | Ruff et al. |
| 4,074,496 | A | 2/1978 | Fischer |
| 4,090,338 | A | 5/1978 | Bourgade |
| 4,094,090 | A | 6/1978 | Walmer |
| 4,095,913 | A | 6/1978 | Pettersson et al. |
| 4,099,358 | A | 7/1978 | Compaan |
| 4,100,710 | A | 7/1978 | Kowallik |
| 4,143,498 | A | 3/1979 | Martin et al. |
| 4,144,689 | A | 3/1979 | Bains |
| 4,150,517 | A | 4/1979 | Warner |
| 4,156,048 | A | 5/1979 | Davis |
| 4,158,335 | A | 6/1979 | Belcastro |
| 4,164,832 | A | 8/1979 | Van Zandt |
| 4,165,305 | A | 8/1979 | Sundie et al. |
| 4,167,599 | A | 9/1979 | Nissinen |
| 4,169,688 | A | 10/1979 | Toshio |
| 4,182,072 | A | 1/1980 | Much |
| 4,186,539 | A | 2/1980 | Harmon et al. |
| 4,196,554 | A | 4/1980 | Anderson et al. |
| 4,198,455 | A | 4/1980 | Spiro et al. |
| 4,226,064 | A | 10/1980 | Kraayenhof |
| 4,242,390 | A | 12/1980 | Nemeth |
| 4,247,390 | A | 1/1981 | Knoll |
| 4,292,774 | A | 10/1981 | Mairle |
| 4,299,070 | A | 11/1981 | Oltmanns et al. |
| 4,304,083 | A | 12/1981 | Anderson |
| 4,316,351 | A | 2/1982 | Ting |
| 4,372,899 | A | 2/1983 | Wiemann et al. |
| 4,376,593 | A | 3/1983 | Schaefer |

(56) References Cited

U.S. PATENT DOCUMENTS

| | | | |
|---|---|---|---|
| 4,390,580 | A | 6/1983 | Donovan et al. |
| 4,416,097 | A | 11/1983 | Weir |
| 4,426,820 | A | 1/1984 | Terbrack et al. |
| 4,435,935 | A | 3/1984 | Larrea |
| 4,449,346 | A | 5/1984 | Tremblay |
| 4,455,803 | A | 6/1984 | Kornberger |
| 4,461,131 | A | 7/1984 | Pressell |
| 4,471,012 | A | 9/1984 | Maxwell |
| 4,489,115 | A | 12/1984 | Layman et al. |
| 4,501,102 | A | 2/1985 | Knowles |
| 4,503,115 | A | 3/1985 | Hemels et al. |
| 4,504,347 | A | 3/1985 | Munk et al. |
| 4,505,887 | A | 3/1985 | Miyata et al. |
| 4,512,131 | A | 4/1985 | Laramore |
| 4,517,147 | A | 5/1985 | Taylor et al. |
| 4,520,062 | A | 5/1985 | Ungar et al. |
| 4,538,392 | A | 9/1985 | Hamar et al. |
| 4,561,233 | A | 12/1985 | Harter et al. |
| 4,571,910 | A | 2/1986 | Cosentino |
| 4,594,347 | A | 6/1986 | Ishikawa et al. |
| 4,599,124 | A | 7/1986 | Kelly et al. |
| 4,599,841 | A | 7/1986 | Haid |
| 4,599,842 | A | 7/1986 | Counihan |
| 4,612,745 | A | 9/1986 | Hovde |
| 4,621,471 | A | 11/1986 | Kuhr et al. |
| 4,640,437 | A | 2/1987 | Weingartner |
| 4,641,469 | A | 2/1987 | Wood |
| 4,643,237 | A | 2/1987 | Rosa |
| 4,646,494 | A | 3/1987 | Saarinen et al. |
| 4,653,138 | A | 3/1987 | Carder |
| 4,653,242 | A | 3/1987 | Ezard |
| 4,672,728 | A | 6/1987 | Nimberger |
| 4,683,631 | A | 8/1987 | Dobbertin |
| 4,703,597 | A | 11/1987 | Eggemar |
| 4,715,162 | A | 12/1987 | Brightwell |
| 4,724,187 | A | 2/1988 | Ungar et al. |
| 4,733,510 | A | 3/1988 | Werner |
| 4,736,563 | A | 4/1988 | Bilhorn |
| 4,738,071 | A | 4/1988 | Ezard |
| 4,741,136 | A | 5/1988 | Thompson |
| 4,747,197 | A | 5/1988 | Charron |
| 4,754,658 | A | 7/1988 | Gutknecht |
| 4,757,657 | A | 7/1988 | Mitchell |
| 4,757,658 | A | 7/1988 | Kaempen |
| 4,766,443 | A | 8/1988 | Winegard et al. |
| 4,769,963 | A | 9/1988 | Meyerson |
| 4,796,402 | A | 1/1989 | Pajala |
| 4,806,435 | A | 2/1989 | Athey |
| 4,819,532 | A | 4/1989 | Benuzzi et al. |
| 4,819,932 | A | 4/1989 | Trotter, Jr. |
| 4,819,935 | A | 4/1989 | Dirksing et al. |
| 4,831,806 | A | 5/1989 | Niese et al. |
| 4,844,972 | A | 7/1989 | Tedeschi et al. |
| 4,845,907 | A | 7/1989 | Meek |
| 4,888,933 | A | 12/1989 | Guomundsson et al. |
| 4,893,449 | A | 1/1990 | Kemper |
| 4,894,272 | A | 1/1990 | Aisley |
| 4,905,442 | A | 3/1990 | Daniels |
| 4,906,484 | A | 3/1990 | Lambuth et al. |
| 4,910,280 | A | 3/1990 | Robbins, III |
| 4,917,532 | A | 4/1990 | Haberhauer et al. |
| 4,920,626 | A | 5/1990 | Nimberger |
| 4,940,503 | A | 7/1990 | Lindgren et al. |
| 4,952,775 | A | 8/1990 | Yokoyama et al. |
| 4,953,335 | A | 9/1990 | Kawaguchi et al. |
| 4,988,131 | A | 1/1991 | Wilson et al. |
| 4,998,395 | A | 3/1991 | Bezner |
| 4,998,396 | A | 3/1991 | Palmersten |
| 5,003,016 | A | 3/1991 | Boeder |
| 5,016,413 | A | 5/1991 | Counihan |
| 5,029,425 | A | 7/1991 | Bogataj |
| 5,034,272 | A | 7/1991 | Lindgren et al. |
| 5,050,362 | A | 9/1991 | Tal et al. |
| 5,052,158 | A | 10/1991 | D'Luzansky |
| 5,058,333 | A | 10/1991 | Schwartz |
| 5,070,662 | A | 12/1991 | Niese |
| 5,074,089 | A | 12/1991 | Kemmer et al. |
| 5,086,599 | A | 2/1992 | Meyerson |
| 5,092,095 | A | 3/1992 | Zadok |
| 5,102,253 | A | 4/1992 | Conti |
| 5,109,898 | A | 5/1992 | Schacht |
| 5,113,632 | A | 5/1992 | Hanson |
| 5,117,603 | A | 6/1992 | Weintraub |
| 5,138,812 | A | 8/1992 | Palmersten |
| 5,148,850 | A | 9/1992 | Urbanick |
| 5,155,952 | A | 10/1992 | Herwegh et al. |
| 5,157,890 | A | 10/1992 | Jines |
| 5,165,816 | A | 11/1992 | Parasin |
| 5,179,811 | A | 1/1993 | Walker et al. |
| 5,179,812 | A | 1/1993 | Hill |
| 5,182,892 | A | 2/1993 | Chase |
| 5,215,802 | A | 6/1993 | Sijpesteijn |
| 5,216,861 | A | 6/1993 | Meyerson |
| 5,244,303 | A | 9/1993 | Hair |
| 5,247,773 | A | 9/1993 | Weir |
| 5,253,464 | A | 10/1993 | Nilsen |
| 5,259,162 | A | 11/1993 | Nicholas |
| 5,266,384 | A | 11/1993 | O'Dell et al. |
| 5,271,564 | A | 12/1993 | Smith |
| 5,274,979 | A | 1/1994 | Tsai |
| 5,283,102 | A | 2/1994 | Sweet et al. |
| 5,292,155 | A | 3/1994 | Bell et al. |
| 5,295,341 | A | 3/1994 | Kajiwara |
| 5,313,751 | A | 5/1994 | Wittler |
| 5,325,649 | A | 7/1994 | Kajiwara |
| 5,343,665 | A | 9/1994 | Palmersten |
| 5,344,700 | A | 9/1994 | McGath et al. |
| 5,348,778 | A | 9/1994 | Knipp et al. |
| 5,349,796 | A | 9/1994 | Meyerson |
| 5,359,817 | A | 11/1994 | Fulton |
| 5,365,713 | A | 11/1994 | Nicholas et al. |
| 5,390,457 | A | 2/1995 | Sjolander |
| 5,413,840 | A | 5/1995 | Mizuno |
| 5,424,118 | A | 6/1995 | McLaughlin |
| 5,425,302 | A | 6/1995 | Levrai et al. |
| 5,433,048 | A | 7/1995 | Strasser |
| 5,433,806 | A | 7/1995 | Pasquali et al. |
| 5,437,934 | A | 8/1995 | Witt et al. |
| 5,474,831 | A | 12/1995 | Nystrom |
| 5,475,960 | A | 12/1995 | Lindal |
| 5,497,589 | A | 3/1996 | Porter |
| 5,502,939 | A | 4/1996 | Zadok et al. |
| 5,526,857 | A | 6/1996 | Forman |
| 5,527,128 | A | 6/1996 | Rope et al. |
| 5,540,025 | A | 7/1996 | Takehara et al. |
| D373,203 | S | 8/1996 | Kornfalt |
| 5,555,980 | A | 9/1996 | Johnston et al. |
| 5,566,519 | A | 10/1996 | Almaraz-Miera |
| 5,567,497 | A | 10/1996 | Zegler et al. |
| 5,570,554 | A | 11/1996 | Searer |
| 5,581,967 | A | 12/1996 | Glatz |
| 5,597,024 | A | 1/1997 | Bolyard et al. |
| 5,618,602 | A | 4/1997 | Nelson |
| 5,618,612 | A | 4/1997 | Gstrein |
| 5,623,799 | A | 4/1997 | Kowalski |
| 5,630,304 | A | 5/1997 | Austin |
| 5,647,181 | A | 7/1997 | Hunts |
| 5,657,598 | A | 8/1997 | Wilbs et al. |
| 5,671,575 | A | 9/1997 | Wu |
| 5,685,117 | A | 11/1997 | Nicholson |
| 5,688,569 | A | 11/1997 | Gilmore et al. |
| 5,692,354 | A | 12/1997 | Searer |
| 5,695,875 | A | 12/1997 | Larsson et al. |
| 5,706,621 | A | 1/1998 | Pervan |
| 5,706,623 | A | 1/1998 | Brown |
| 5,719,239 | A | 2/1998 | Mirous et al. |
| 5,735,092 | A | 4/1998 | Clayton et al. |
| 5,736,227 | A | 4/1998 | Sweet et al. |
| 5,755,068 | A | 5/1998 | Ormiston |
| 5,765,808 | A | 6/1998 | Butschbacher et al. |
| 5,768,850 | A | 6/1998 | Chen |
| 5,791,114 | A | 8/1998 | Mandel |
| 5,797,237 | A | 8/1998 | Finkell, Jr. |
| 5,823,240 | A | 10/1998 | Bolyard et al. |

(56) References Cited

U.S. PATENT DOCUMENTS 5,827,592 A 10/1998 Van Gulik et al.
5,860,267 A 1/1999 Pervan
D406,360 S 3/1999 Finkell, Jr.
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,937,612 A 8/1999 Winer et al.
5,941,047 A 8/1999 Johansson
5,943,239 A 8/1999 Shamblin et al.
5,945,181 A 8/1999 Fisher
5,950,389 A 9/1999 Porter
5,968,625 A 10/1999 Hudson
5,971,655 A 10/1999 Shirakawa
5,987,839 A 11/1999 Hamar et al.
5,987,845 A 11/1999 Laronde
5,996,301 A 12/1999 Conterno
6,006,486 A 12/1999 Moriau et al.
6,012,263 A 1/2000 Church et al.
6,021,615 A 2/2000 Brown
6,021,646 A 2/2000 Burley
6,023,907 A 2/2000 Pervan
6,029,416 A 2/2000 Andersson
6,079,182 A 6/2000 Ellenberger
6,094,882 A 8/2000 Pervan
6,098,365 A 8/2000 Martin et al.
6,101,778 A 8/2000 Martensson
6,106,654 A 8/2000 Velin et al.
6,119,423 A 9/2000 Costantino
6,122,879 A 9/2000 Montes
6,134,854 A 10/2000 Stanchfield
6,141,920 A 11/2000 Kemper
6,143,119 A 11/2000 Seidner
6,148,884 A 11/2000 Bolyard et al.
6,158,915 A 12/2000 Kise
6,164,031 A 12/2000 Counihan
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 4/2001 Roy et al.
6,219,982 B1 4/2001 Eyring
6,230,385 B1 5/2001 Nelson
6,233,899 B1 5/2001 Mellert et al.
6,247,285 B1 6/2001 Moebus
6,253,514 B1 7/2001 Jobe et al.
6,271,156 B1 8/2001 Gleason et al.
6,314,701 B1 11/2001 Meyerson
6,321,499 B1 11/2001 Chuang
6,324,796 B1 12/2001 Heath
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,363,677 B1 4/2002 Chen et al.
6,363,678 B1 4/2002 Shuler
6,365,258 B1 4/2002 Alm
6,365,936 B1 4/2002 Shimabukuro et al.
6,385,936 B1 5/2002 Schneider
6,397,547 B1 6/2002 Martensson
6,418,683 B1 7/2002 Martensson et al.
6,421,970 B1 7/2002 Martensson et al.
6,423,257 B1 7/2002 Stobart
6,438,919 B1 8/2002 Knauseder
6,446,405 B1 9/2002 Pervan
6,446,413 B1 9/2002 Gruber
6,449,918 B1 9/2002 Nelson
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,517,935 B1 2/2003 Kornfalt et al.
6,521,314 B2 2/2003 Tychsen
6,526,719 B2 3/2003 Pletzer et al.
6,532,709 B2 3/2003 Pervan
6,536,178 B1 3/2003 Palsson
6,546,691 B2 4/2003 Leopolder
6,550,205 B2 4/2003 Neuhofer
6,551,007 B2 4/2003 Lichtenberg et al.
6,588,165 B1 7/2003 Wright
6,588,166 B2 7/2003 Martensson et al.
6,591,568 B1 7/2003 Palsson
6,601,359 B2 8/2003 Olofsson
6,606,834 B2 8/2003 Martensson et al.
6,647,689 B2 11/2003 Pletzer et al.
6,647,690 B1 11/2003 Martensson
6,670,019 B2 12/2003 Andersson
6,672,030 B2 1/2004 Schulte
6,681,820 B2 1/2004 Olofsson
6,682,254 B1 1/2004 Olofsson
6,685,391 B1 2/2004 Gideon
6,711,869 B2 3/2004 Tychsem
6,729,091 B1 5/2004 Martensson
6,745,534 B2 6/2004 Kornfalt
6,763,643 B1 7/2004 Martensson
6,769,219 B2 8/2004 Schwitte et al.
6,769,835 B2 8/2004 Stridsman
6,786,016 B1 9/2004 Wood
6,802,166 B1 10/2004 Gerhard
6,804,926 B1 10/2004 Eisermann
6,805,951 B2 10/2004 Kornfalt et al.
6,851,237 B2 2/2005 Niese et al.
6,851,241 B2 2/2005 Pervan
6,854,235 B2 2/2005 Martensson
6,860,074 B2 3/2005 Stanchfield
6,862,857 B2 3/2005 Tychsen
6,865,855 B2 3/2005 Knauseder
6,880,305 B2 4/2005 Pervan et al.
6,880,307 B2 4/2005 Schwitte et al.
6,898,913 B2 5/2005 Pervan
6,918,220 B2 7/2005 Pervan
6,920,732 B2 7/2005 Martensson
6,922,964 B2 8/2005 Pervan
6,931,798 B1 8/2005 Pocai
6,966,161 B2 11/2005 Palsson et al.
RE38,950 E 1/2006 Maiers et al.
7,003,924 B2 2/2006 Kettler et al.
7,021,019 B2 4/2006 Knauseder
7,051,486 B2 5/2006 Pervan
7,086,205 B2 8/2006 Pervan
7,121,058 B2 10/2006 Palsson et al.
7,121,059 B2 10/2006 Pervan
7,131,242 B2 11/2006 Martensson
7,146,772 B2 12/2006 Ralf
7,152,507 B2 12/2006 Solari
7,188,456 B2 3/2007 Knauseder
7,210,272 B2 5/2007 Friday
7,251,916 B2 8/2007 Konzelmann et al.
7,332,053 B2 2/2008 Palsson et al.
7,337,588 B1 3/2008 Moebus
7,347,328 B2 3/2008 Hartwall
7,377,081 B2 5/2008 Ruhdorfer
7,398,628 B2 7/2008 Van Horne
7,441,385 B2 10/2008 Palsson et al.
7,444,791 B1 11/2008 Pervan
7,451,578 B2 11/2008 Hannig
7,484,337 B2 2/2009 Hecht
7,497,058 B2 3/2009 Martensson
7,552,568 B2 6/2009 Palsson et al.
7,603,826 B1 10/2009 Moebus
7,614,197 B2 11/2009 Nelson
7,617,651 B2 11/2009 Grafenauer
7,634,884 B2 12/2009 Pervan et al.
7,665,267 B2 2/2010 Moriau et al.
7,726,088 B2 6/2010 Muehlebach
7,820,287 B2 10/2010 Kornfalt et al.
7,856,784 B2 12/2010 Martensson

(56) References Cited

U.S. PATENT DOCUMENTS

| | | | |
|---|---|---|---|
| 7,856,785 | B2 | 12/2010 | Pervan |
| 7,856,789 | B2 | 12/2010 | Eisermann |
| 7,877,956 | B2 | 2/2011 | Martensson |
| 7,896,571 | B1 | 3/2011 | Hannig et al. |
| 7,980,039 | B2 | 7/2011 | Groeke et al. |
| 7,980,043 | B2 | 7/2011 | Moebus |
| 8,006,458 | B1 | 8/2011 | Olofsson et al. |
| 8,028,486 | B2 | 10/2011 | Pervan et al. |
| 8,037,657 | B2 | 10/2011 | Sjoberg et al. |
| 8,038,363 | B2 | 10/2011 | Hannig et al. |
| 8,117,795 | B2 | 2/2012 | Knauseder |
| 8,146,318 | B2 | 4/2012 | Palsson |
| 8,234,834 | B2 | 8/2012 | Martensson et al. |
| 8,276,342 | B2 | 10/2012 | Martensson |
| 8,402,709 | B2 | 3/2013 | Martensson |
| 8,429,869 | B2 | 4/2013 | Pervan |
| 8,544,233 | B2 | 10/2013 | Palsson |
| 8,578,675 | B2 * | 11/2013 | Palsson et al. ..... 52/592.2 |
| 8,615,952 | B2 | 12/2013 | Engstrom |
| 8,631,623 | B2 | 1/2014 | Engstrom |
| 8,720,148 | B2 | 5/2014 | Engstrom |
| 8,789,334 | B2 | 7/2014 | Moriau et al. |
| 2001/0024707 | A1 | 9/2001 | Andersson et al. |
| 2001/0029720 | A1 | 10/2001 | Pervan |
| 2002/0007608 | A1 | 1/2002 | Pervan |
| 2002/0046526 | A1 | 4/2002 | Knauseder |
| 2002/0046528 | A1 | 4/2002 | Pervan et al. |
| 2002/0095895 | A1 | 7/2002 | Daly et al. |
| 2002/0100242 | A1 | 8/2002 | Olofsson |
| 2002/0112429 | A1 | 8/2002 | Niese et al. |
| 2002/0112433 | A1 | 8/2002 | Pervan |
| 2002/0127374 | A1 | 9/2002 | Spratling |
| 2002/0148551 | A1 | 10/2002 | Knauseder |
| 2002/0178673 | A1 | 12/2002 | Pervan |
| 2002/0178674 | A1 | 12/2002 | Pervan |
| 2002/0178681 | A1 | 12/2002 | Zancai et al. |
| 2002/0178682 | A1 | 12/2002 | Pervan |
| 2002/0189183 | A1 | 12/2002 | Ricciardelli |
| 2002/0189747 | A1 | 12/2002 | Steinwender |
| 2003/0009971 | A1 | 1/2003 | Palmberg |
| 2003/0009972 | A1 | 1/2003 | Pervan et al. |
| 2003/0024199 | A1 | 2/2003 | Pervan et al. |
| 2003/0024200 | A1 | 2/2003 | Moriau et al. |
| 2003/0033784 | A1 | 2/2003 | Pervan |
| 2003/0084634 | A1 | 5/2003 | Stanchfield |
| 2003/0084636 | A1 | 5/2003 | Pervan |
| 2003/0094230 | A1 | 5/2003 | Sjoberg |
| 2003/0118812 | A1 | 6/2003 | Kornfalt |
| 2003/0141004 | A1 | 7/2003 | Palmblad |
| 2003/0145540 | A1 | 8/2003 | Brunedal |
| 2003/0154678 | A1 | 8/2003 | Stanchfield |
| 2003/0159389 | A1 | 8/2003 | Kornfalt |
| 2003/0224147 | A1 | 12/2003 | Maine et al. |
| 2004/0016197 | A1 | 1/2004 | Ruhdorfer |
| 2004/0031225 | A1 | 2/2004 | Fowler |
| 2004/0031226 | A1 | 2/2004 | Miller |
| 2004/0031227 | A1 | 2/2004 | Knauseder |
| 2004/0035077 | A1 | 2/2004 | Martensson et al. |
| 2004/0040235 | A1 | 3/2004 | Kurtz |
| 2004/0041225 | A1 | 3/2004 | Nemoto |
| 2004/0139678 | A1 | 7/2004 | Pervan |
| 2004/0182036 | A1 | 9/2004 | Sjoberg et al. |
| 2004/0191461 | A1 | 9/2004 | Riccobene |
| 2004/0211143 | A1 | 10/2004 | Hanning |
| 2004/0211144 | A1 | 10/2004 | Stanchfield |
| 2004/0250492 | A1 | 12/2004 | Becker |
| 2005/0034405 | A1 | 2/2005 | Pervan |
| 2005/0144881 | A1 | 7/2005 | Tate |
| 2005/0166526 | A1 | 8/2005 | Stanchfield |
| 2005/0210810 | A1 | 9/2005 | Pervan |
| 2005/0252130 | A1 | 11/2005 | Martensson |
| 2006/0101769 | A1 | 5/2006 | Pervan |
| 2006/0236642 | A1 | 10/2006 | Pervan |
| 2006/0248836 | A1 | 11/2006 | Martensson |
| 2007/0006543 | A1 | 1/2007 | Engstrom |
| 2007/0028547 | A1 | 2/2007 | Grafenauer et al. |
| 2007/0240376 | A1 | 10/2007 | Engstrom |
| 2008/0000186 | A1 | 1/2008 | Pervan |
| 2008/0134613 | A1 | 6/2008 | Pervan |
| 2008/0216434 | A1 | 9/2008 | Pervan |
| 2008/0236088 | A1 | 10/2008 | Hannig |
| 2008/0271403 | A1 | 11/2008 | Palsson |
| 2009/0019806 | A1 | 1/2009 | Muehlebach |
| 2009/0064624 | A1 | 3/2009 | Sokol |
| 2009/0100782 | A1 | 4/2009 | Groeke et al. |
| 2009/0193748 | A1 | 8/2009 | Boo et al. |
| 2009/0199500 | A1 | 8/2009 | LeBlang |
| 2009/0217615 | A1 | 9/2009 | Engstrom |
| 2009/0249733 | A1 | 10/2009 | Moebus |
| 2010/0031599 | A1 | 2/2010 | Kennedy et al. |
| 2010/0043333 | A1 | 2/2010 | Hannig |
| 2010/0058700 | A1 | 3/2010 | LeBlang |
| 2010/0236707 | A1 | 9/2010 | Studer et al. |
| 2011/0167751 | A1 | 7/2011 | Engstrom |
| 2011/0173914 | A1 | 7/2011 | Engstrom |
| 2011/0271631 | A1 | 11/2011 | Engstrom |
| 2011/0271632 | A1 | 11/2011 | Cappelle et al. |
| 2011/0293361 | A1 | 12/2011 | Olofsson |
| 2012/0042595 | A1 | 2/2012 | De Boe |
| 2012/0055112 | A1 | 3/2012 | Engstrom |
| 2012/0216472 | A1 | 8/2012 | Martensson et al. |
| 2012/0233948 | A1 | 9/2012 | Palsson |
| 2012/0247053 | A1 | 10/2012 | Martensson |
| 2012/0291396 | A1 | 11/2012 | Martensson |
| 2012/0304590 | A1 | 12/2012 | Engstrom |
| 2013/0042555 | A1 | 2/2013 | Martensson |
| 2013/0067840 | A1 | 3/2013 | Martensson |
| 2013/0291467 | A1 | 11/2013 | Palsson et al. |
| 2014/0137506 | A1 | 5/2014 | Palsson |
| 2014/0157711 | A1 | 6/2014 | Palsson et al. |
| 2014/0157721 | A1 | 6/2014 | Engstrom |

FOREIGN PATENT DOCUMENTS

| | | | |
|---|---|---|---|
| AU | 199732569 | | 12/1999 |
| AU | 200020703 | | 6/2000 |
| BE | 417526 | | 12/1936 |
| BE | 556860 | A | 5/1957 |
| BE | 557844 | | 3/1960 |
| BE | 765817 | A2 | 9/1971 |
| BE | 1010339 | | 6/1998 |
| BE | 1010487 | | 10/1998 |
| CA | 991373 | | 6/1976 |
| CA | 1049736 | A1 | 3/1979 |
| CA | 1169106 | | 6/1984 |
| CA | 1325873 | C | 1/1994 |
| CA | 2226286 | | 12/1997 |
| CA | 2252791 | | 5/1999 |
| CA | 2162836 | C | 6/1999 |
| CA | 2289309 | | 11/1999 |
| CA | 2150384 | C | 4/2005 |
| CH | 200949 | | 1/1939 |
| CH | 211677 | | 1/1941 |
| CH | 211877 | | 1/1941 |
| CH | 562 377 | | 5/1975 |
| CH | 640455 | A5 | 1/1984 |
| CN | 1054215 | A | 9/1991 |
| CN | 2091909 | U | 1/1992 |
| CN | 1115351 | A | 1/1996 |
| CN | 1124941 | A | 6/1996 |
| CN | 2242278 | Y | 12/1996 |
| DE | 209979 | | 11/1906 |
| DE | 1212275 | | 3/1966 |
| DE | 1934295 | U | 3/1966 |
| DE | 1985418 | | 5/1968 |
| DE | 1534802 | | 4/1970 |
| DE | 1534802 | A1 | 4/1970 |
| DE | 7102476 | | 6/1971 |
| DE | 1658875 | B1 | 9/1971 |
| DE | 2007129 | A1 | 9/1971 |
| DE | 1534278 | | 11/1971 |
| DE | 2139283 | A1 | 2/1972 |
| DE | 2101782 | | 7/1972 |
| DE | 2102537 | A1 | 8/1972 |

(56) References Cited

FOREIGN PATENT DOCUMENTS

| | | | |
|---|---|---|---|
| DE | 2145024 | | 3/1973 |
| DE | 2159042 | | 6/1973 |
| DE | 2205232 | A1 | 8/1973 |
| DE | 2238660 | | 2/1974 |
| DE | 2251762 | | 5/1974 |
| DE | 2252643 | A1 | 5/1974 |
| DE | 7402354 | | 5/1974 |
| DE | 2502992 | | 7/1976 |
| DE | 2552622 | A1 | 5/1977 |
| DE | 2616077 | | 10/1977 |
| DE | 2802151 | A1 | 7/1979 |
| DE | 2917025 | | 11/1980 |
| DE | 2916482 | A1 | 12/1980 |
| DE | 2927425 | A1 | 1/1981 |
| DE | 3104519 | | 2/1981 |
| DE | 2940945 | A1 | 4/1981 |
| DE | 3041781 | | 6/1982 |
| DE | 3046618 | A1 | 7/1982 |
| DE | 3117605 | A1 | 11/1982 |
| DE | 3214207 | | 11/1982 |
| DE | 3246376 | | 6/1984 |
| DE | 3304992 | | 8/1984 |
| DE | 3306609 | | 9/1984 |
| DE | 3319235 | | 11/1984 |
| DE | 3343601 | | 6/1985 |
| DE | 3412882 | A1 | 10/1985 |
| DE | 8604004 | | 4/1986 |
| DE | 3512204 | | 10/1986 |
| DE | 3544845 | | 6/1987 |
| DE | 3631390 | | 12/1987 |
| DE | 3640822 | | 6/1988 |
| DE | 3741041 | A1 | 9/1988 |
| DE | 8600241 | | 4/1989 |
| DE | 3933611 | A1 | 4/1991 |
| DE | 4002547-0 | | 8/1991 |
| DE | 4105207 | A1 | 8/1991 |
| DE | 3932980 | | 11/1991 |
| DE | 4130115 | A1 | 3/1993 |
| DE | 9300306 | | 3/1993 |
| DE | 4134452 | | 4/1993 |
| DE | 4215273 | | 11/1993 |
| DE | 4242530 | | 6/1994 |
| DE | 43 44 089 | | 7/1994 |
| DE | 4313037 | C1 | 8/1994 |
| DE | 9317191 | | 3/1995 |
| DE | 4402352 | A1 | 8/1995 |
| DE | 19503948 | A1 | 8/1996 |
| DE | 29520966 | U1 | 8/1996 |
| DE | 296 14 086 | | 10/1996 |
| DE | 19601322 | A1 | 5/1997 |
| DE | 29703962 | | 6/1997 |
| DE | 29710175 | | 8/1997 |
| DE | 29711960 | | 10/1997 |
| DE | 19651149 | | 6/1998 |
| DE | 19704292 | A1 | 8/1998 |
| DE | 19709641 | | 9/1998 |
| DE | 19718319 | A1 | 11/1998 |
| DE | 19821938 | | 11/1999 |
| DE | 19851200 | C1 | 3/2000 |
| DE | 20001225 | | 7/2000 |
| DE | 19940837 | A1 | 11/2000 |
| DE | 19925248 | | 12/2000 |
| DE | 20018284 | | 1/2001 |
| DE | 19933343 | A1 | 2/2001 |
| DE | 20017461 | | 2/2001 |
| DE | 20027461 | | 3/2001 |
| DE | 19963203 | A1 | 9/2001 |
| DE | 100 01 076 | | 10/2001 |
| DE | 517353 | | 5/2002 |
| DE | 20203311 | U1 | 5/2002 |
| DE | 10062873 | | 7/2002 |
| DE | 10120062 | A1 | 11/2002 |
| DE | 10131248 | | 1/2003 |
| DE | 10242647 | A1 | 6/2004 |
| DE | 10 2005 002 297.9 | | 8/2005 |
| DE | 10 2007 035 648 | | 1/2009 |
| DE | 2009 022 483.1 | | 5/2009 |
| DE | 20 2009 004 530 | | 6/2009 |
| DE | 10 2010 004717.1 | | 1/2010 |
| DE | 10 2010 020 089.1 | | 5/2010 |
| DE | 10 2009 038 750 | | 3/2011 |
| EP | 0024360 | A1 | 3/1981 |
| EP | 0044371 | A1 | 1/1982 |
| EP | 0085196 | | 8/1983 |
| EP | 0117707 | A2 | 9/1984 |
| EP | 0161233 | A1 | 11/1985 |
| EP | 0196672 | A2 | 10/1986 |
| EP | 0220389 | A2 | 5/1987 |
| EP | 0248127 | | 12/1987 |
| EP | 0256189 | A1 | 2/1988 |
| EP | 0279278 | A2 | 8/1988 |
| EP | 0335778 | A2 | 10/1989 |
| EP | 0401146 | A1 | 12/1990 |
| EP | 0220389 | | 5/1992 |
| EP | 0487925 | A1 | 6/1992 |
| EP | 0508083 | A1 | 10/1992 |
| EP | 0508260 | A2 | 10/1992 |
| EP | 0562402 | A1 | 9/1993 |
| EP | 0604896 | A1 | 7/1994 |
| EP | 0623724 | | 11/1994 |
| EP | 0652332 | A1 | 5/1995 |
| EP | 0652340 | | 5/1995 |
| EP | 0690185 | A1 | 1/1996 |
| EP | 0698162 | | 2/1996 |
| EP | 000711886 | | 5/1996 |
| EP | 0715037 | A1 | 6/1996 |
| EP | 0799679 | A2 | 10/1997 |
| EP | 0813641 | A1 | 12/1997 |
| EP | 0843763 | | 5/1998 |
| EP | 0849416 | | 6/1998 |
| EP | 0855482 | | 7/1998 |
| EP | 0877130 | | 11/1998 |
| EP | 0903451 | | 3/1999 |
| EP | 0906994 | A1 | 4/1999 |
| EP | 0958441 | | 11/1999 |
| EP | 0969163 | | 1/2000 |
| EP | 0969164 | | 1/2000 |
| EP | 0974713 | | 1/2000 |
| EP | 1045083 | A1 | 10/2000 |
| EP | 1120515 | A1 | 8/2001 |
| EP | 1146182 | A2 | 10/2001 |
| EP | 1229181 | | 8/2002 |
| EP | 1262608 | A2 | 12/2002 |
| EP | 1279778 | A2 | 1/2003 |
| EP | 1308577 | A2 | 5/2003 |
| EP | 1350904 | A2 | 10/2003 |
| EP | 1359266 | A2 | 11/2003 |
| EP | 1367194 | A2 | 12/2003 |
| EP | 1420125 | A2 | 5/2004 |
| EP | 1437457 | A2 | 7/2004 |
| EP | 2400076 | | 8/2004 |
| EP | 2 034 106 | | 3/2009 |
| FI | 843060 | | 8/1984 |
| FR | 557844 | | 8/1923 |
| FR | 1175582 | | 3/1959 |
| FR | 1215852 | | 4/1960 |
| FR | 1293043 | | 5/1962 |
| FR | 1372596 | A | 9/1964 |
| FR | 1511292 | A | 1/1968 |
| FR | 2209024 | A1 | 6/1974 |
| FR | 2268922 | A1 | 11/1975 |
| FR | 2278876 | A1 | 2/1976 |
| FR | 2345560 | A1 | 10/1977 |
| FR | 2362254 | A1 | 3/1978 |
| FR | 2416988 | A1 | 9/1979 |
| FR | 2445874 | A1 | 8/1980 |
| FR | 2568295 | | 1/1986 |
| FR | 2630149 | | 10/1989 |
| FR | 2637932 | | 4/1990 |
| FR | 2675174 | | 10/1992 |
| FR | 2691491 | | 11/1993 |
| FR | 2891491 | | 11/1993 |
| FR | 2691691 | | 12/1993 |
| FR | 2697275 | | 4/1994 |

(56) References Cited

FOREIGN PATENT DOCUMENTS

| | | | |
|---|---|---|---|
| FR | 2712329 | | 5/1995 |
| FR | 2781513 | | 1/2000 |
| FR | 2785633 | | 5/2000 |
| FR | 2810060 | | 12/2001 |
| GB | 240629 | A | 10/1925 |
| GB | 356270 | A | 9/1931 |
| GB | 424057 | | 2/1935 |
| GB | 448329 | A | 6/1936 |
| GB | 471438 | A | 9/1937 |
| GB | 585205 | | 1/1947 |
| GB | 589635 | A | 6/1947 |
| GB | 599793 | | 3/1948 |
| GB | 636423 | | 4/1950 |
| GB | 647812 | A | 12/1950 |
| GB | 812671 | | 4/1959 |
| GB | 875327 | A | 8/1961 |
| GB | 1027709 | A | 4/1966 |
| GB | 1039949 | A | 8/1966 |
| GB | 1127915 | A | 9/1968 |
| GB | 1161838 | A | 8/1969 |
| GB | 1171337 | A | 11/1969 |
| GB | 1183401 | A | 3/1970 |
| GB | 1191656 | A | 5/1970 |
| GB | 1212983 | | 11/1970 |
| GB | 1237744 | | 6/1971 |
| GB | 1275511 | A | 5/1972 |
| GB | 1308011 | A | 2/1973 |
| GB | 1348272 | | 3/1974 |
| GB | 1430423 | | 3/1976 |
| GB | 1445687 | A | 8/1976 |
| GB | 1485419 | A | 9/1977 |
| GB | 2117813 | | 10/1983 |
| GB | 2124672 | A | 2/1984 |
| GB | 2126106 | | 3/1984 |
| GB | 2142670 | | 1/1985 |
| GB | 2168732 | | 6/1986 |
| GB | 2167465 | | 1/1989 |
| GB | 2221740 | A | 2/1990 |
| GB | 2228753 | | 9/1990 |
| GB | 2240039 | A | 7/1991 |
| GB | 2243381 | | 10/1991 |
| GB | 2256023 | | 11/1992 |
| GB | 2325342 | A | 11/1998 |
| GB | 2365880 | A | 2/2002 |
| IT | 444123 | | 1/1949 |
| IT | 812671 | | 4/1959 |
| JP | 5465528 | | 5/1979 |
| JP | 57119056 | | 7/1982 |
| JP | 59041560 | A | 3/1984 |
| JP | 59186336 | | 12/1984 |
| JP | 64-14838 | | 1/1989 |
| JP | 64-14839 | | 1/1989 |
| JP | 1178659 | | 7/1989 |
| JP | H 01178659 | A | 7/1989 |
| JP | 02285145 | | 11/1990 |
| JP | H 02285145 | A | 11/1990 |
| JP | 3-18343 | | 2/1991 |
| JP | 3-44645 | | 4/1991 |
| JP | 3046645 | | 4/1991 |
| JP | 3-110258 | | 5/1991 |
| JP | 3169967 | | 7/1991 |
| JP | 3-202550 | | 9/1991 |
| JP | 4106264 | | 4/1992 |
| JP | 4191001 | | 7/1992 |
| JP | H 04191001 | A | 7/1992 |
| JP | 04261955 | | 9/1992 |
| JP | H 0518028 | A | 1/1993 |
| JP | 5148984 | | 6/1993 |
| JP | 6-146553 | | 5/1994 |
| JP | 6200611 | A | 7/1994 |
| JP | 656310 | | 8/1994 |
| JP | 6315944 | A | 11/1994 |
| JP | 6320510 | | 11/1994 |
| JP | 752103 | | 2/1995 |
| JP | 407052103 | | 2/1995 |
| JP | 7076923 | | 3/1995 |
| JP | 8109734 | A | 4/1995 |
| JP | 7180333 | | 7/1995 |
| JP | 7189466 | A | 7/1995 |
| JP | 7229276 | | 8/1995 |
| JP | H 07229276 | A | 8/1995 |
| JP | 7279366 | | 10/1995 |
| JP | H 07279366 | A | 10/1995 |
| JP | 7300979 | | 11/1995 |
| JP | 7310426 | | 11/1995 |
| JP | 961207 | | 2/1996 |
| JP | H 0874405 | A | 3/1996 |
| JP | 8086078 | | 4/1996 |
| JP | H 0886078 | A | 4/1996 |
| JP | 8270193 | A | 10/1996 |
| JP | H 08268344 | A | 10/1996 |
| JP | H 0938906 | A | 2/1997 |
| JP | H 0988315 | A | 3/1997 |
| JP | H 09256603 | A | 9/1997 |
| JP | H 10219975 | A | 8/1998 |
| JP | 5154806 | B2 | 8/2008 |
| JP | 4203141 | B2 | 12/2008 |
| JP | 5304714 | B2 | 10/2013 |
| KR | 9533446 | A | 12/1995 |
| NL | 7601773 | | 2/1975 |
| NO | 157871 | | 7/1984 |
| NO | 305614 | | 5/1995 |
| PL | 24931 | U1 | 11/1974 |
| PL | 26931 | | 6/1989 |
| SE | 372051 | | 12/1974 |
| SE | 7114900-9 | | 12/1974 |
| SE | 7706470 | | 12/1978 |
| SE | 450141 | | 6/1987 |
| SE | 8206934-5 | | 6/1987 |
| SE | 457737 | | 1/1989 |
| SE | 462809 | | 4/1990 |
| SE | 467150 | | 6/1992 |
| SE | 501014 | | 10/1994 |
| SE | 9301595-6 | | 10/1994 |
| SE | 9500810 | | 3/1995 |
| SE | 502994 | | 3/1996 |
| SE | 503861 | | 9/1996 |
| SE | 509059 | | 11/1998 |
| SE | 509060 | | 11/1998 |
| SE | 512290 | | 2/2000 |
| SE | 512313 | | 2/2000 |
| SE | 513189 | | 7/2000 |
| SE | 514645 | | 3/2001 |
| SE | 0001149 | | 10/2001 |
| SU | 363795 | | 11/1973 |
| SU | 857393 | A1 | 8/1981 |
| WO | WO 80/02155 | | 10/1980 |
| WO | WO 82/00313 | A1 | 2/1982 |
| WO | WO 84/02155 | | 6/1984 |
| WO | WO 84/02155 | A1 | 6/1984 |
| WO | WO 8703839 | | 7/1987 |
| WO | WO 90/00656 | A1 | 1/1990 |
| WO | WO 92/12074 | A2 | 7/1992 |
| WO | WO 9217657 | | 10/1992 |
| WO | WO 93/13280 | | 7/1993 |
| WO | WO 93/19910 | A1 | 10/1993 |
| WO | WO 9401628 | | 1/1994 |
| WO | WO 94/04773 | A1 | 3/1994 |
| WO | WO 94/22678 | A1 | 10/1994 |
| WO | WO 9426999 | | 11/1994 |
| WO | WO 95/05274 | A1 | 2/1995 |
| WO | WO 95/06176 | A1 | 3/1995 |
| WO | WO 95/14834 | A1 | 6/1995 |
| WO | WO 96/12857 | | 5/1996 |
| WO | WO 96/23942 | | 8/1996 |
| WO | WO 9627719 | | 9/1996 |
| WO | WO 9627721 | | 9/1996 |
| WO | WO 9630177 | | 10/1996 |
| WO | WO 9747834 | | 12/1997 |
| WO | WO 98/22677 | A1 | 5/1998 |
| WO | WO 9822678 | | 5/1998 |
| WO | WO 9824994 | | 6/1998 |
| WO | WO 9824995 | | 6/1998 |
| WO | WO 9858142 | | 12/1998 |

(56) References Cited

FOREIGN PATENT DOCUMENTS

| | | | |
|---|---|---|---|
| WO | WO 9901628 | | 1/1999 |
| WO | WO 99/13179 | A1 | 3/1999 |
| WO | WO 9940273 | | 8/1999 |
| WO | WO 9966151 | | 12/1999 |
| WO | WO 9966152 | | 12/1999 |
| WO | WO 0006854 | | 2/2000 |
| WO | WO 00/20705 | | 4/2000 |
| WO | WO 00/20706 | A1 | 4/2000 |
| WO | WO 00/47841 | | 8/2000 |
| WO | WO 0056802 | | 9/2000 |
| WO | WO 0063510 | | 10/2000 |
| WO | WO 0066856 | | 11/2000 |
| WO | WO 01/02669 | | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 0002214 | | 3/2001 |
| WO | WO 0120101 | | 3/2001 |
| WO | WO 01/31141 | | 5/2001 |
| WO | WO 01/48332 | A1 | 7/2001 |
| WO | WO 01/51732 | | 7/2001 |
| WO | WO 01/51733 | | 7/2001 |
| WO | WO 01/53628 | A1 | 7/2001 |
| WO | WO 01/66877 | A1 | 9/2001 |
| WO | WO 01/75247 | | 10/2001 |
| WO | WO 01/77461 | A1 | 10/2001 |
| WO | WO 01/88306 | A1 | 11/2001 |
| WO | WO 01/88307 | A1 | 11/2001 |
| WO | WO 01/98604 | A1 | 12/2001 |
| WO | WO 02/055809 | A1 | 7/2002 |
| WO | WO 02/055810 | A1 | 7/2002 |
| WO | WO 2007/089186 | | 8/2002 |
| WO | WO 02/081843 | | 10/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | | 10/2003 |
| WO | WO 03/087497 | A1 | 10/2003 |
| WO | WO 03/089736 | A1 | 10/2003 |
| WO | WO 03093686 | | 11/2003 |
| WO | WO 2004/016877 | A1 | 2/2004 |
| WO | WO 2004/020764 | A1 | 3/2004 |
| WO | WO 2005/040521 | | 5/2005 |
| WO | WO 2005/054599 | | 6/2005 |
| WO | WO 2005/054599 | A1 | 6/2005 |
| WO | WO 2005/059269 | | 6/2005 |
| WO | WO 2006/043893 | | 4/2006 |
| WO | WO 2007/008139 | | 1/2007 |
| WO | WO 2007/141605 | | 12/2007 |
| WO | WO 2008/004960 | | 1/2008 |
| WO | WO 2008/068245 | | 6/2008 |
| WO | WO 2009/066153 | | 5/2009 |
| WO | WO 2009/139687 | | 11/2009 |
| WO | WO 2010/082171 | | 7/2010 |
| WO | WO 2010/136171 | | 12/2010 |
| WO | WO 2011/085788 | | 7/2011 |
| WO | WO 2011/141043 | | 11/2011 |

OTHER PUBLICATIONS

Knight's American Mechanical Dictionary, vol. III. 1876, definition of scarf.

Traditional Details; For Building Restoration, Renovation, and Rehabilitation: From the 1932-1951 Editions of Architectvral Graphic Standards; John Wiley & Sons, Inc.

Traindustrins Handbok "Snickeriarbete", Knut Larsson, Tekno's Handbocker Publikation 12-11 (1952).

Elements of Rolling Practice; The United Steel Companies Limited Sheffield, England, 1963; pp. 116-117.

Die mobile; Terbrack; 1968.

High-Production Roll Forming; Society of Manufacturing Engineers Marketing Services Depmiment; pp. 189-192; George T. Halmos; 1983.

Fundamentals of Building Construction Materials and Methods; Copyright 1985; pp. 11.

Automated Program of Designing Snap-fits; Aug. 1987; pp. 3.

Plastic Part Technology; 1991; pp. 161-162.

Technoscope; Modern Plastics, Aug. 1991; pp. 29-30.

Encyclopedia of Wood Joints; A Fine Woodworking Book; pp. 1-151; 1992.

Whittington's Dictionary of Plastics; Edited by James F. Carley, Ph.D., PE; pp. 443, 461; 1993.

Patent Mit Inter-nationalem, Die Revolution ((von Grund auf)) Fibo-Trespo, Disstributed at the Domotex fair in Hannover, Germany in Jan. 1996.

Wood Handbook; Forest Products Laboratory, 1999; "Glossary pp. G-1 to 0-14", "Chapter 10, pp. 10-1 to 10-31".

Focus, Information Till Ana Medabetare, Jan. 2001, Kahrs pa Domotex I Hmmover, Tyskim1d, Jan. 13-16, 2001.

Search Report dated Apr. 21, 2001.

Letter of the USPTO dated May 14, 2002, regarding U.S. Appl. No. 90/005,744.

Non-Final Office Action for U.S. Appl. No. 10/270,163 dated Dec. 10, 2004.

Final Office Action for U.S. Appl. No. 10/270,163 dated Jun. 2, 2005.

Non-Final Office Action for U.S. Appl. No. 10/270,163 dated Dec. 14, 2005.

Final Office Action for U.S. Appl. No. 10/270,163 dated May 25, 2006.

Non-Final Office Action for U.S. Appl. No. 11/185,724 dated Sep. 26, 2006.

Non-Final Office Action for U.S. Appl. No. 11/483,636 dated Oct. 11, 2006.

Reexamination U.S. Appl. No. 90/007,366 dated Oct. 24, 2006.

Reexamination U.S. Appl. No. 90/007,526 dated Dec. 5, 2006.

Non-Final Office Action for U.S. Appl. No. 11/185,724 dated Apr. 19, 2007.

Non-Final Office Action for U.S. Appl. No. 11/483,636 dated Apr. 19, 2007.

Non-Final Office Action for U.S. Appl. No. 11/015,741 dated Sep. 6, 2007.

Non-Final Office Action for U.S. Appl. No. 11/242,127 dated Nov. 1, 2007.

Non-Final Office Action for U.S. Appl. No. 11/185,724 dated Jan. 9, 2008.

Final Office Action for U.S. Appl. No. 11/015,741 dated Feb. 26, 2008.

Non-Final Office Action for U.S. Appl. No. 11/483,636 dated Apr. 3, 2008.

Non-Final Office Action for U.S. Appl. No. 11/242,127 dated Apr. 29, 2008.

United States District Court Eastern District of Wisconsin; Order; Dated May 1, 2008.

Examiner Interview Summary for U.S. Appl. No. 11/015,741 dated May 7, 2008.

Final Office Action for U.S. Appl. No. 11/185,724 dated Jul. 9, 2008.

Non-Final Office Action for U.S. Appl. No. 10/580,191 dated Jul. 16, 2008.

Reexamination U.S. Appl. No. 90/007,365 dated Aug. 5, 2008.

United States District Court Eastern District of Wisconsin; Judgment; Dated Oct. 10, 2008.

United States District Court Eastern District of Wisconsin; Order; Dated Oct. 10, 2008.

Final Office Action for U.S. Appl. No. 11/483,636 dated Nov. 20, 2008.

United States District Court Eastern District of Wisconsin; Order; Dated Dec. 31, 2008.

Non-Final Office Action for U.S. Appl. No. 11/242,127 dated Mar. 31, 2009.

Non-Final Office Action for U.S. Appl. No. 12/010,587 dated Jun. 23, 2009.

Non-Final Office Action for U.S. Appl. No. 11/483,636 dated Jul. 21, 2009.

(56) References Cited

OTHER PUBLICATIONS

Non-Final Office Action for U.S. Appl. No. 12/010,587 dated Oct. 10, 2012.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
United States Court of Appeals for Federal Circuit; 2009-1107,-1122; Decided: Feb. 18, 2010.
Appeals from the United States District Court for the Eastern District of Wisconsin; Consolidated casse No. 02-CV-0736 and 03-CV-616; Judge J.P. Stadtmueller, 2009-1107,-1122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
United States Court of Appeals of the Federal Circuit; Case No. 02-CV-0736 and 03-CV-616; Mandate issued on Apr. 12, 2010; Judgment; 2 pages.
Final Office Action for U.S. Appl. No. 12/278,274 dated May 17, 2010.
Final Office Action for U.S. Appl. No. 12/010,587 dated May 25, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Non-Final Office Action for U.S. Appl. No. 12/010,587 dated Mar. 16, 2011.
International Search Report for Application No. PCT/EP2010/006772 dated Mar. 31, 2011.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 12/010,587 dated Aug. 30, 2011.
Non-Final Office Action for U.S. Appl. No. 11/483,636 dated Sep. 28, 2011.
Decision revoking the European Patent EP-B-1 276 941 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl. No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Notice of Allowance for U.S. Appl. No. 12/966,861 dated Apr. 11, 2012.
Non-Final Office Aciton for U.S. Appl. No. 13/437,597 dated Jul. 9, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Non-Final Office Action for U.S. Appl. No. 13/204,481 dated Sep. 7, 2012.
Non-Final Office Action for U.S. Appl. No. 13/567,933 dated Sep. 12, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Action for U.S. Appl. No. 11/015,741 dated Mar. 13, 2013.
Final Office Action for U.S. Appl. No. 13/567,933 dated Mar. 15, 2013.
Notice of Allowance for U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 datde Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aug. 14, 2013.
Notice of Allowance for U.S. Appl. No. 13/559,230 datde Aug. 20, 2013.
Non-Final Office Action for U.S. Appl. No. 13/860,315 dated Aug. 26, 2013.
Notice of Allowance for U.S. Appl. No. 11/185,724 dated Sep. 3, 2013.

(56) References Cited

OTHER PUBLICATIONS

Non-Final Office Action for U.S. Appl. No. 13/204,481 dated Sep. 4, 2013.
Final Office Aciton for U.S. Appl. No. 13/620,098 dated Sep. 24, 2013.
Non-Final Office Action for U.S. Appl. No. 13/463,329 dated Sep. 25, 2013.
Notice of Allowance for U.S. Appl. No. 13/675,936 dated Sep. 25, 2013.
Supplemental Notice of Allowance for U.S. Appl. No. 12/966,797 dated Oct. 3, 2013.
Supplemental Notice of Allowance for U.S. Appl. No. 13/559,230 dated Oct. 4, 2013.
Notice of Allowance for U.S. Appl. No. 11/185,725 dated Nov. 1, 2013.
Final Office Action for U.S. Appl. No. 12/747,454 dated Nov. 6, 2013.
Notice of Allowance for U.S. Appl. No. 13/086,931 dated Nov. 19, 2013.
Final Office Action for U.S. Appl. No. 12/747,454 dated Feb. 24, 2014.
Supplemental Notice of Allowance for U.S. Appl. No. 13/086,931 dated Apr. 14, 2014.
Abandoned U.S. Appl. No. 13/420,282 dated Mar. 24, 2014.
Pending U.S. Appl. No. 14/223,365 dated Mar. 24, 2014.
Non-Final Office Action for U.S. Appl. No. 14/098,187 datde Jun. 16, 2014.
European Patent Office Opposition Division Decision for Application No. 01906461.7 dated Oct. 21, 2011.
European Patent Office Board of Appeal Decision for Application No. 01906461.7 dated Jul. 24, 2014.

* cited by examiner

BUILDING PANELS

CROSS-REFERENCE TO RELATED APPLICATIONS

This application is a continuation of and claims priority to U.S. application Ser. No. 13/860,315, filed Apr. 10, 2013 which is a continuation of and claims priority to U.S. application Ser. No. 13/437,597, filed Apr. 2, 2012, now U.S. Pat. No. 8,544,233, which is a continuation of and claims priority to U.S. application Ser. No. 12/240,739, filed Sep. 29, 2008, now U.S. Pat. No. 8,146,318, which claimed priority to: U.S. application Ser. No. 11/540,583, filed Oct. 2, 2006, now U.S. Pat. No. 7,441,385; U.S. application Ser. No. 09/672,076, filed Sep. 29, 2000, now U.S. Pat. No. 6,591,568; U.S. application Ser. No. 09/988,014, filed Nov. 16, 2001; U.S. application Ser. No. 10/242,674, filed Sep. 13, 2002, now U.S. Pat. No. 7,332,053; and to Swedish Application No. 0001149-4, filed Mar. 31, 2000. The entire disclosures of each of the above applications are incorporated herein by reference in their entireties.

BACKGROUND

1. Field of the Invention

The present invention relates to a flooring material comprising sheet-shaped floor elements which are joined by means of joining members.

2. Background

Prefabricated floor boards provided with tongue and groove at the edges are quite common nowadays. These can be installed by the average handy man as they are very easy to install. Such floors can, for example. be constituted of solid wood, or of wood particles consolidated by use of a binder including fibre board, such as high or medium density fibre board (HDF or MDF), particle board, chip board, oriented strand board (OSB) or any other construction comprising particles of wood bonded together with a binder. These are most often provided with a surface layer such as lacquer, or some kind of laminate. The boards are most often installed by being glued via tongue and groove. The most common types of longue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilize in floors where no glue is to be used.

Such a joint is known through WO 94/26999 (herein incorporated by reference in its entirety) which deals with a system to join two floor boards. The floor boards are provided with a locking device at the rear sides. In one embodiment the floor boards are provided with profiles on the lower side at a first long side and short side: These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges. The intentions are that the profiles shall bend downwards and then to snap back into the groove when assembled. The profiles are integrated with the floor boards through folding or alternatively, through gluing.

According to WO 94/26999, the floor boards may be joined by turning or prizing it into position with the long side edge as a pivot point. It is then necessary to slide the floor board longitudinally so that it snaps into the floor board previously installed in the same row. A play is essential in order to achieve that. This play seems to be marked Δ in the figures. A tolerance of ±2 mm is mentioned in the application. Such a play will naturally cause undesired gaps between the floor boards. Dirt and moisture can penetrate into these gaps.

It is also known through WO 97/47834 (herein incorporated by reference in its entirety) to manufacture a joint where the floor boards are joined by turning or prizing it into position with the long side edge as a pivot point. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts, i.e. the tongue and groove, is in opposite to the invention according to WO 94/26999 above, where they are constituted by separate parts, seems to be manufactured monolithically from the core of the floor board. WO 97/47834 does also show how the tongue and groove with heels and recesses according to the invention is tooled by means of cutting machining. This invention does also have the disadvantage that the best mode of joining floor boards includes longitudinal sliding for joining the short sides of the floor boards, which also here will require a play which will cause unwanted gaps between the floor boards. Dirt and moisture can penetrate into these gaps.

SUMMARY OF THE INVENTION

It is, through the present invention, made possible to solve the above mentioned problems whereby a floor element which can be assembled without having to be slid along already assembled floor elements has been achieved. Accordingly, the invention relates to a flooring material comprising sheet-shaped floor elements with a mainly square or rectangular shape. The floor elements are provided with edges, a lower side and an upper decorative layer. The floor elements are intended to be joined by means of joining members. The invention is characterized in that;

a) The floor elements are provided with male joining members on a first edge while a second, opposite, edge of the floor elements are provided with a female joining member. The male joining member is provided with a tongue and a lower side groove. The female joining member is provided with a groove and a cheek, the cheek being provided with a lip. The floor elements are intended to mainly be joined together by tilting the floor element to be joined with an already installed floor element or a row of already installed floor elements, with the male joining member of the floor element angled downwards and that the first edge is allowed to be mainly parallel to the second edge of the already installed floor element or elements. The tongue of the tilted floor element is then inserted into the groove of the female joining member of the already installed floor element or elements. The tilted floor element is then turned downwards, with its lower edge as a pivot axis, so that the lip eventually snaps into the lower side groove where the decorative upper layer of the floor elements are mainly parallel.

b) The floor elements are moreover provided with a male vertical assembly joining member on a third edge while a fourth edge is provided with female vertical assembly joining member. The fourth edge is arranged on a side opposite to the third edge.

c) The floor elements are alternatively provided with a male vertical assembly joining member on a third edge, while a fourth edge also is provided with male vertical assembly joining member. The fourth edge is arranged on a side opposite to the third edge. Adjacent male vertical assembly joining members are thereby joined by means of a separate vertical assembly joining profile. Two adjacent edges of a floor element can hereby be joined with a floor element adjacent to the first edge and a floor element adjacent to the third or fourth edge at the same time, and in the same turning motion.

The force needed to overcome the static friction along the joint between two completely assembled male and female joining members is preferably larger than 10 N per meter of joint length, suitably larger than 100 N per meter of joint length.

According to one embodiment of the invention, the floor elements are provided with male vertical assembly joining members on a third edge and provided with female vertical assembly joining members on a fourth edge. The male vertical assembly joining members are provided with mainly vertical lower cheek surfaces arranged parallel to the closest edge. The lower cheek surfaces are intended to interact with mainly vertical upper cheek surfaces arranged on the female vertical assembly joining members so that two joined adjacent floor elements are locked against each other in a horizontal direction. The male and female vertical assembly joining members are provided with one or more snapping hooks with matching under cuts which by being provided with mainly horizontal locking surfaces limits the vertical movement between two joined adjacent floor elements.

The floor elements may alternatively be provided with male vertical assembly joining members on both a third and a fourth edge. These edges are then snap joined by means of a vertical assembly profile which on both sides of a longitudinal symmetry line is designed as a female vertical assembly joining member according to the description above. Two joined adjacent floor elements are locked to each other in a horizontal direction via the vertical assembly profile while, at the same time, vertical movement between two joined adjacent floor elements is limited.

The joint between a third and a fourth edge of two joined floor elements preferably comprises contact surfaces which are constituted by the horizontal locking surfaces of the under cuts and hooks, the mainly vertical upper cheek surfaces and lower cheek surfaces as well as upper mating surfaces.

The joint between two joined floor elements suitably also comprises cavities.

According to one embodiment of the invention the snapping hook is constituted by a separate spring part which is placed in a cavity. Alternatively the undercut is constituted by a separate spring part which is placed in a cavity. The spring part is suitably constituted by an extruded thermoplastic profile, a profile of thermosetting resin or an extruded metal profile.

The vertical assembly joining profiles are suitably shaped as extended profiles which suitably are manufactured through extrusion which is a well known and rational method. The vertical assembly joining profiles are suitably shaped as extended lengths or rolls which can be cut to the desired length. The length of the vertical assembly joining profiles considerably exceeds the length of a floor element, before being cut. The lateral joints of the floor will only need shorter pieces of vertical assembly joining profiles which are positioned as each new floor board is introduced to a row. Vertical assembly joining profiles according to the present invention may be manufactured of a number of different materials and manufacturing methods. Among the most suited can, however, be mentioned injection moulding and extrusion. Suitable materials are thermoplastic materials such as polyolefins, polystyrene, polyvinyl chloride or acrylnitrile-butadiene-styrene copolymer. These may suitably be filled with, for example, wood powder or lime in order to increase the rigidity but also to increase the adhesion when glue is used. It is also possible to mill a vertical assembly joining profile from a material such as wood, fibre board or particle board.

The flooring material including the floor boards and joining profiles above is most suited when installing floors where it isn't desired to use glue. It is, however, possible to use glue or twin-faced adhesive tape in order to make the installation irreversibly permanent. The glue or tape is then suitably applied on, or in connection to, possible cavities or faces below the upper mating surfaces.

BRIEF DESCRIPTION OF THE DRAWINGS

The invention is described further in connection to enclosed figures showing different embodiments of a flooring material whereby.

DETAILED DESCRIPTION OF THE INVENTION

Figure 1:
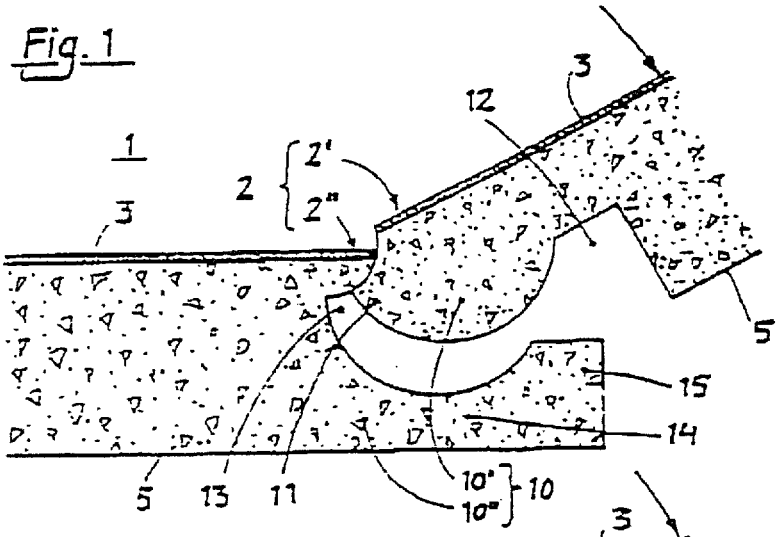
FIG. 1 shows, in cross-section, a first and a second edge $\mathbf{2}^{I}$ and $2^{II}$ respectively, during joining

FIG. 1 shows, in cross-section, a first and a second edge $2^{I}$ and $2^{II}$ respectively, during assembly. The figure shows pans of a flooring material comprising sheet-shaped floor elements 1 with a mainly square or rectangular shape. The floor elements 1 are provided with edges 2, a lower side 5 and an upper decorative layer 3. The floor elements 1 are intended to be joined by means of joining members 10. Such floors floor elements, for example, be constituted of solid wood, fibre board, such as medium density fibre board (MDF), particle board, chip board, or any other construction comprising pieces or particles of wood, including combinations of plastic elements and the particles or pieces of wood. The floor elements 1 are provided with male joining members 101 on a first edge $2^{I}$ while a second edge $2^{II}$ of the floor elements 1 are provided with a female joining member $10^{II}$. The second edge $2^{II}$ is arranged on a side opposite to the first edge $2^{I}$. The male joining member $10^{I}$ is provided with a tongue 11 and a lower side 5 groove 12. The female joining member $10^{II}$ is provided with a groove 13 and a cheek 14, the cheek 14 being provided with a lip 15. The floor elements 1 are intended to mainly be joined together by tilting the floor element 1 to be joined with an already installed floor element 1 or a row of already installed floor elements 1, with the male joining member $10^{I}$ of the floor element 1 angled downwards and that the first edge 21 is allowed to be mainly parallel to the second edge $2^{II}$ of the already installed floor element 1 or elements 1. The tongue 11 of the tilted floor element 1 is then inserted into the groove 13 of the female joining member $10^{II}$ of the already installed floor element 1 or elements 1, whereby the tilted floor element 1 is turned downwards, with its lower edge as a pivot axis, so that the lip 15 eventually falls into the lower side 5 groove 12 where the decorative upper layer 3 of the floor elements 1 are mainly parallel.

The embodiment shown in FIG. 1 corresponds mainly with the one shown in FIG. 1. The lip 15 and lower side 5 groove 12 are, however, provided with a cam 16 and a cam groove 17 which provides a snap action locking.

Figure 2:
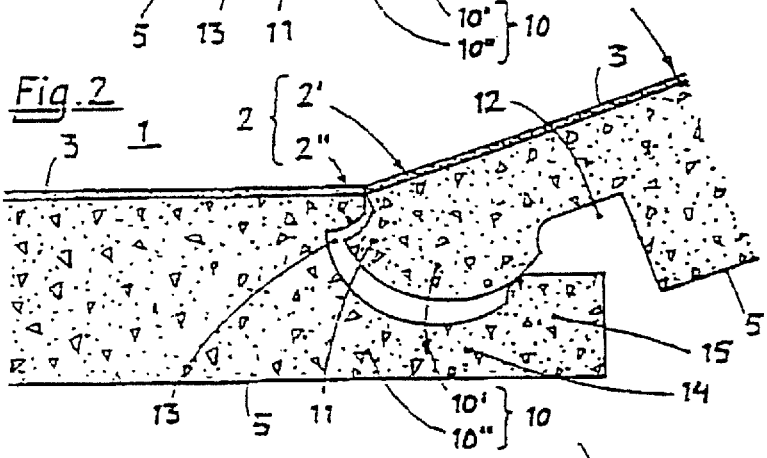
FIG. 2 shows, in cross-section, a second embodiment of a first and a second edge $\mathbf{2}^{I}$ and $\mathbf{2}^{II}$ respectively, during joining.
Figure 3:
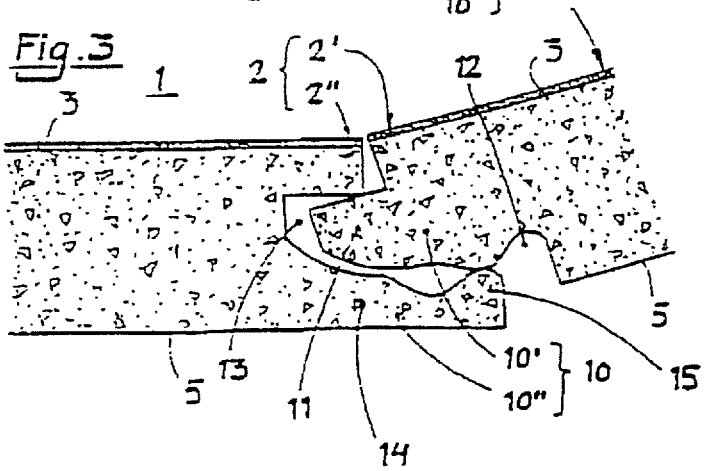
FIG. 3 shows, in cross-section, a third embodiment of a first and a second edge $\mathbf{2}^{I}$ and $\mathbf{2}^{II}$ respectively, during joining.

The embodiment shown in FIG. 3 corresponds mainly with the one shown in FIGS. 1 and 2 above. The lip 15 and lower side 5 groove 12 are, however, provided with a cam 16 and a cam groove 17 which provides a snap action locking.

Figure 4:
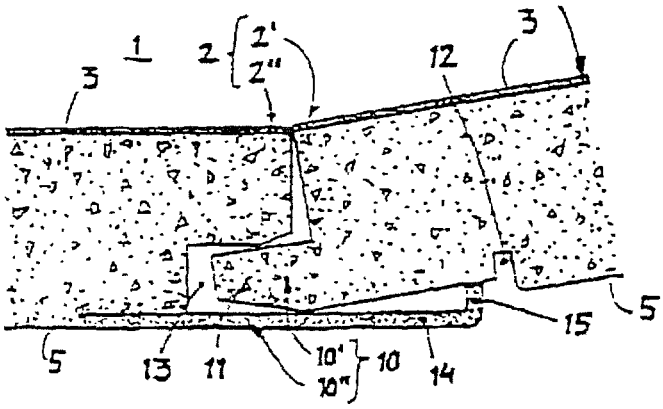
FIG. 4 shows, in cross-section, a fourth embodiment of a first and a second edge $\mathbf{2}^{I}$ and $\mathbf{2}^{II}$ respectively, during joining.

The embodiment shown in FIG. 4 corresponds mainly with the one shown in FIG. 1 above. The lip 15 and cheek 14 is however shaped as a thin resilient section which provides a snap action locking.

Figure 5:
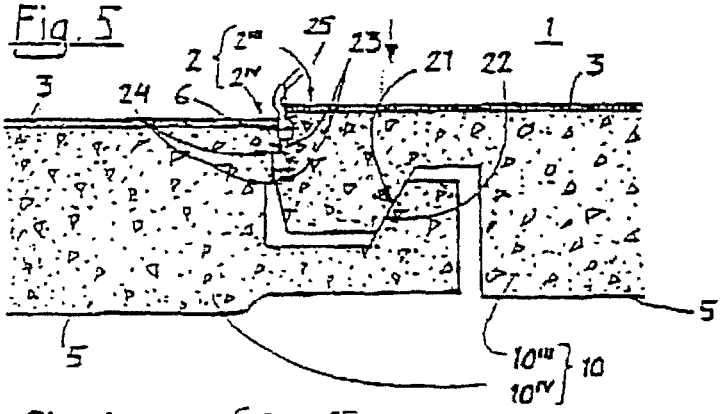
FIG. 5 shows, in cross-section, a third and a fourth edge $\mathbf{2}^{I}$ and $\mathbf{2}^{IV}$ respectively, during joining.

FIG. 5 shows, in cross-section, a third and a fourth edge $2^{II}$ and $2^{IV}$ respectively, of a floor element 1 according to any of the FIGS. 1 to 4. The floor elements 1 are provided with a male vertical assembly joining member $10^{III}$ on a third edge $2^{III}$ while a fourth edge $2^{IV}$ is provided with a female vertical assembly joining member $10^{IV}$. The fourth edge $2^{IV}$ is placed on a side opposite to the third edge $2^{III}$. The male vertical assembly joining members $10^{III}$ are provided with mainly vertical lower cheek surfaces 21 arranged parallel to the closest edge 2. The lower cheek surfaces 21 are intended to interact with mainly vertical upper cheek surfaces 22 arranged on the female vertical assembly joining members $10^{IV}$ so that two joined adjacent floor elements 1 are locked against each other in a horizontal direction. The male vertical assembly joining members $10^{III}$ are moreover provided with two snapping hooks 23 while the female vertical assembly joining members $10^{IV}$ are provided with matching under cuts 24, which by being provided with mainly horizontal locking surfaces limits the vertical movement between two joined adjacent floor elements 1.

The joint between a third and a fourth edge $2^{III}$ and $2^{IV}$ respectively of two joined floor elements 1 further comprises contact surfaces which are constituted by the horizontal locking surfaces of the under cuts 24 and hooks 23, the mainly vertical upper cheek surfaces 22 lower cheek surfaces as well as upper mating surfaces 25. The joint between two joined floor elements 1 also comprises cavities 6.

Figure 6:
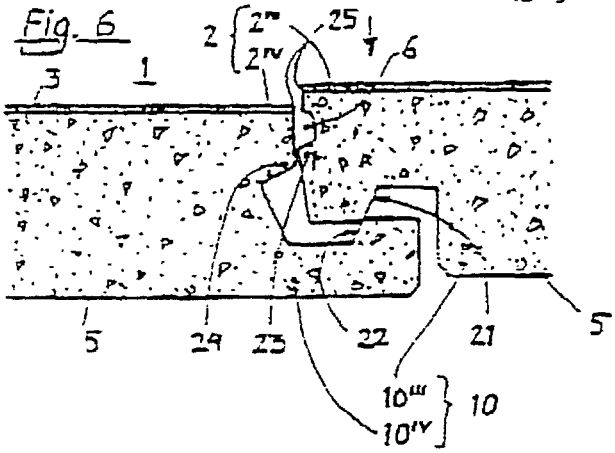
FIG. 6 shows, in cross-section, a second embodiment of a third and a fourth edge $\mathbf{2}^{III}$ and $\mathbf{2}^{IV}$ respectively, during joining.

The embodiment shown in FIG. 6 corresponds in the main with the one shown in FIG. 5. The male vertical assembly joining members $10^{III}$ are, however, provided with only one snapping hook 23 while the female vertical assembly joining members $10^{IV}$ are provided with a matching undercut 24, which by being provided with mainly horizontal locking surfaces limits vertical movement between to joined adjacent floor boards 1.

Figure 7:
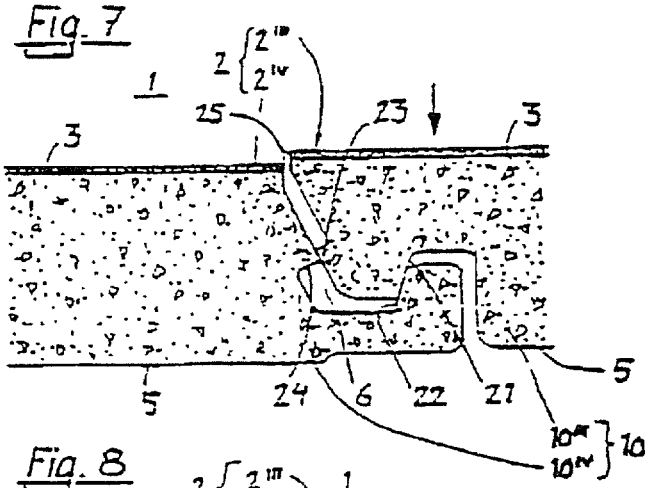
FIG. 7 shows, in cross-section, a third embodiment of a third and a fourth edge $^{2III}$ and $\mathbf{2}^{IV}$ respectively, during joining.

The embodiment shown in FIG. 7 corresponds in the main with the one shown in FIG. 6. The snapping hook 23 on the male vertical assembly joining member $10^{III}$ is, however, moved somewhat inwards in the floor element 1 whereby a guiding angle is formed above the undercut 24 of the female vertical joining member $10^{IV}$.

Figure 8:
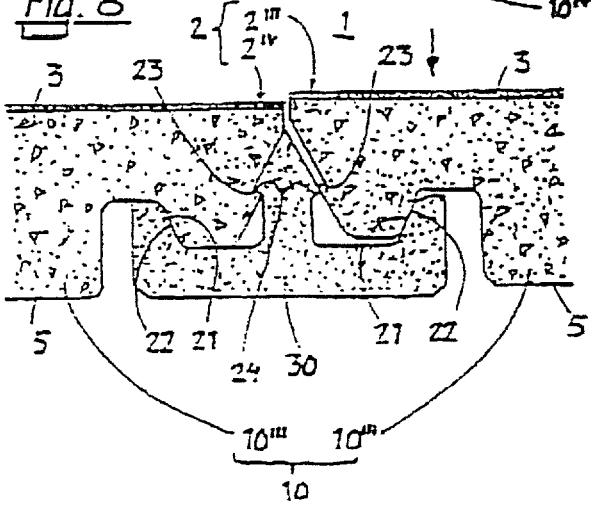
FIG. 8 shows, in cross-section, a fourth embodiment of a third and a fourth edge $\mathbf{2}^{III}$ and $\mathbf{2}^{IV}$ respectively and a vertical assembly joining profile 30, during joining.

The embodiment shown in FIG. 8 corresponds mainly with the one shown in FIG. 7. Both the third and the fourth edges $2^{III}$ and $2^{IV}$ respectively are, however, provided with male vertical assembly joining members $10^{III}$. A vertical assembly joining profile 30, provided with a female vertical assembly joining profile $10^{IV}$ on both sides of a vertical symmetry line, is used for joining the two floor elements 1. The female vertical assembly joining members $10^{IV}$ of the vertical assembly joining profile 30 are equipped similar to the female vertical assembly joining members $10^{IV}$ in FIG. 7 above.

Two adjacent edges 2 of a floor element 1 can at the same time, and in the same turning motion, be joined with a floor element 1 adjacent to the first edge 21 and a floor element 1 adjacent to the third or fourth edge $2^{III}$ and $2^{IV}$ respectively, when assembling floor elements 1 according to the above described embodiments.

The floor elements 1 according to the present invention most often comprises a core. The core is most often comprised of particles or fibre of wood bonded with resin or glue. It is advantageous to coat the surface closest to the joint in cases where the floor will be exposed to high levels of moisture since the cellulose based material is sensitive to moisture. This coating may suitably incorporate resin. wax or some kind of lacquer. It is not necessary to coal the joint when it is to be glued since the glue itself will protect from moisture penetration. The upper decorative layer 3 is constituted of a decorative paper impregnated with melamine-formaldehyde resin. One or more so called overlay sheets of a-cellulose, impregnated with melamineformaldehyde resin may possibly be placed on top of the decorative layer. The abrasion resistance may be improved by sprinkling one or more of the sheets with hard panicles of for example α-aluminium oxide, silicon carbide or silicon oxide. The lower side 5 may suitably be coated with lacquer or a layer of paper and resin.

FIGS. 9-16 demonstrate the improvement of the radially projected dimension of the length (L) of the groove or undercut and the horizontal rotated radially projected height (L) of the lip or upper cheek surface of the boards of the invention. With respect to FIGS. 9-12, the radially projected dimension, indicated at a, corresponds to the length of the groove 13, while β indicates the horizontal rotated length of lip 15.

Additionally, $\gamma$ indicates the length of the tongue 11, while $\delta$ is the horizontal rotated length of the locking groove 12. Because $\alpha$ is greater than $\gamma$, and $\beta$ is greater than $\delta$, adjacent floor elements cannot be assembled horizontally. In other words, because tongue 11 (as well as groove 13) is greater than lip 15 (as well as locking groove 12), the floor elements depicted in these figures can only be assembled by rotating or turning one of the floor elements. Generally, in each of these figures, $\alpha$ is substantially equal to $\gamma$ and $\beta$ is substantially equal to $\delta$. This "substantially equal" relationship provides for a close fitting, while limiting movement of adjacent panels once assembled. For example, the difference in dimensions may be from 0.005-5%, or from 0.02-0.5 mm.

In contrast, the floor elements shown in FIGS. 13-16 may be assembled through horizontal motion. Specifically, $\epsilon$ is the length of the undercut 24, while $\zeta$ corresponds to the horizontal rotated length of the upper cheek surface 22. Additionally, $\eta$ indicates the length of the snapping hooks 23, while the horizontal rotated length of the lower cheek surface 21 is specified by $\theta$.

Because $\epsilon$ is less than $\eta$ and $\zeta$ is less than $\theta$, the floor elements can only be assembled through horizontal movement. That is to say, due to the particular dimensions of the undercuts 24, upper cheek surface 22, snapping hooks 23 and lower cheek surface 21, the floor panels of the invention may be joined through substantially vertical movement of one panel with respect to a second panel.

The dimensions $\epsilon$ and $\eta$ may also be related to the thickness of the floor element itself. For example, the ratio between $\epsilon$ and the thickness (or $\eta$ and the surface) may be in the range of about 0.025 to 0.2, typically, about 0.05 to about 0.1, and more typically, about 0.07 to 0.09. That is to say, when the thickness is 8 mm, as is common in conventional boards, $\epsilon$ or $\eta$ would be from 0.2 to 1.5 mm. Additionally, $\alpha$ (or $\gamma$) can be at least 2 times greater than $\beta$ (or $\delta$), while $\epsilon$ (or $\eta$) is at least 2 times $\zeta$ (or $\theta$).

Figure 9:
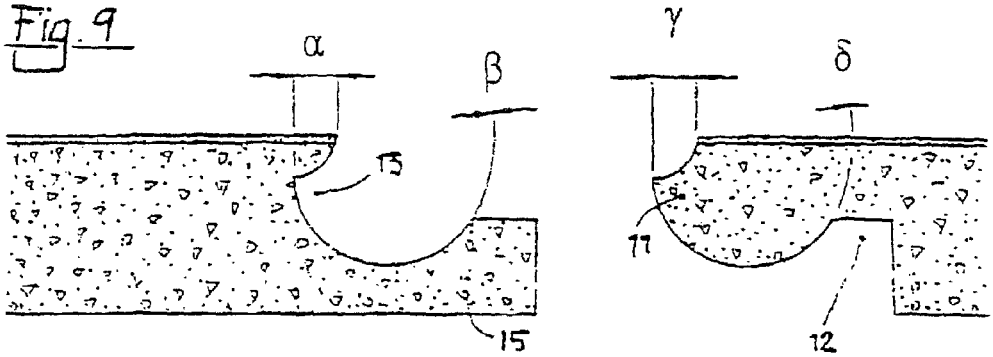
FIG. 9 shows, in cross-section, a first and a second edge $\mathbf{2}^{I}$ and $\mathbf{2}^{II}$ respectively, during joining.
Figure 10:
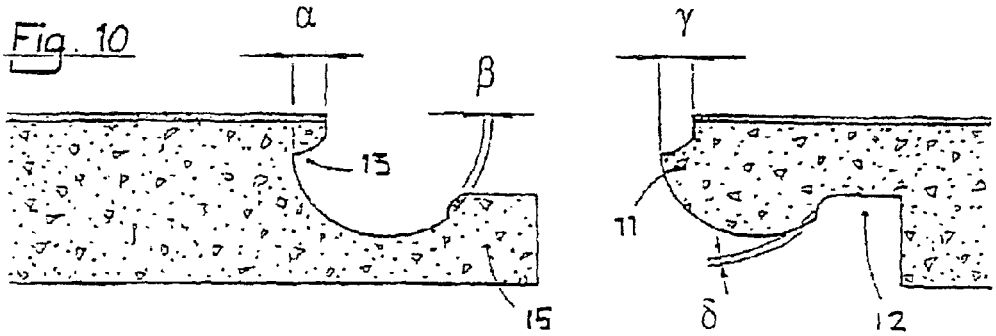
FIG. 10 shows, in cross-section, a second embodiment of a first and a second edge $\mathbf{2}^{I}$ and $\mathbf{2}^{II}$ respectively, during joining.
Figure 11:
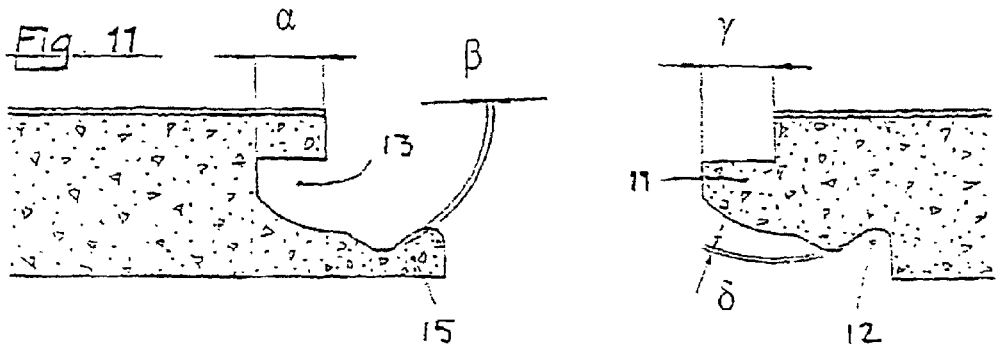
FIG. 11 shows, in cross-section, a third embodiment of a first and a second edge $\mathbf{2}^{I}$ and $\mathbf{2}^{II}$ respectively, during joining.
Figure 12:
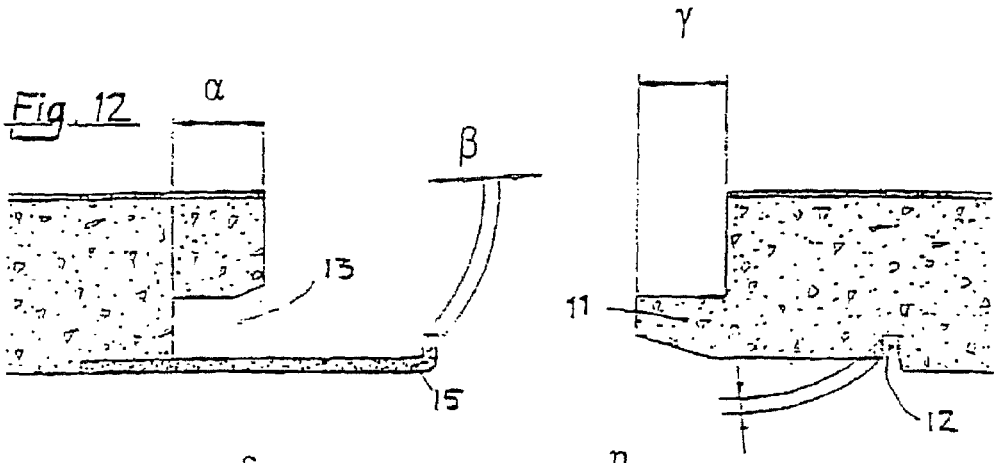
FIG. 12 shows, in cross-section, a fourth embodiment of a first and a second edge $\mathbf{2}^{I}$ an $\mathbf{2}^{II}$ respectively, during joining.
Figure 13:
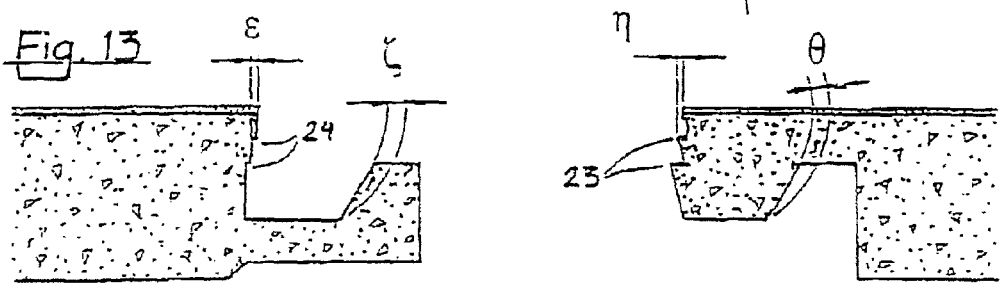
FIG. 13 shows, in cross-section, a third and a fourth edge $\mathbf{2}^{III}$ and $\mathbf{2}^{IV}$ respectively, during joining.
Figure 14:
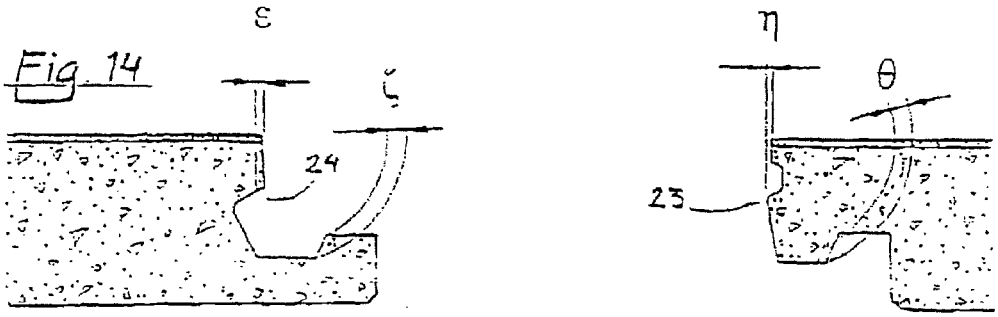
FIG. 14 shows, in cross-section, a second embodiment of a third and a fourth edge $\mathbf{2}^{III}$ and $\mathbf{2}^{IV}$ respectively, during joining.
Figure 15:
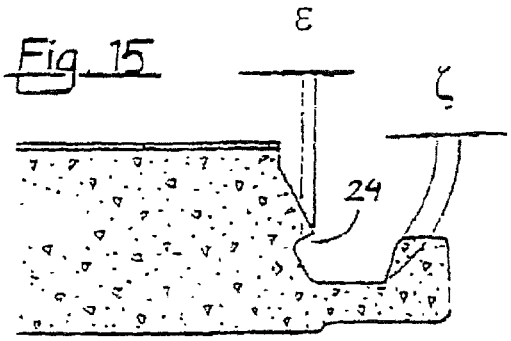
FIG. 15 shows, in cross-section, a third embodiment of a third and a fourth edge $\mathbf{2}^{III}$ and $\mathbf{2}^{IV}$ respectively, during joining.
Figure 15:
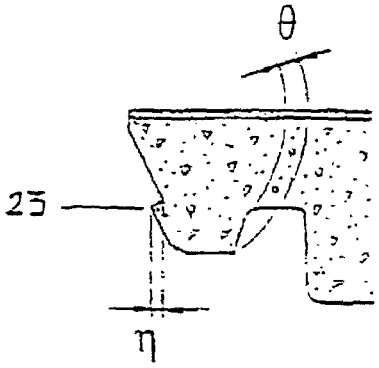
Figure 16:
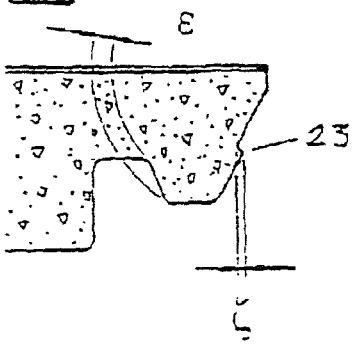
FIG. 16 shows, in cross-section, a fourth embodiment of a third and a fourth edge $2^{III}$ and $2^{IV}$ respectively and a vertical assembly joining profile 30, during joining.
Figure 16:
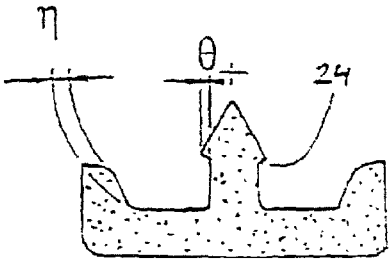

Moreover, all dimension lines of FIGS. 9-16 are intended to indicate the area taken up by the inserted pan as the recesses, such as, the groove 13 and need not be deeper than the tongue 11. Although in some cases, the recesses are deeper than the length of the tongue 11. With particular reference to FIG. 9, $\beta$ effectively is zero, meaning that there is no undercut when pivoting the panel.

Finally, the floor elements of this invention, preferably, comprise vertically-joined edges on at least two sides. For example, when the floor panel has a substantially rectangular shape, such vertically-joined edges may be found on two, three or all four sides. When the vertically-joined edges are located on less than all sides of the floor element, the remaining sides may include, for example, edges joined by rotating or horizontal movement or simple straight edges without a joining profile.

The invention is not limited by the embodiments shown since they can be varied within the scope if the invention.

The invention claimed is:

1. A surface element configured to be assembled together with similar surface elements to form a plurality of joined surface elements, the surface element comprising:

a floor panel substantially made from a board and comprising a decorative upper surface, an opposed lower surface and at least four edges disposed between the upper and lower surfaces;

the four edges comprising a first edge and a second edge defining a first pair of opposite sides, and a third edge and a fourth edge defining a second pair of opposite sides;

the first edge of the surface element comprises a first male joining member and a second edge comprises a first female joining member;

the first male joining member comprising a tongue and the first female joining member comprising a groove;

the first male joining member and the first female joining member configured such that two of such surface elements can be coupled and vertically as well as horizontally locked at their respective first and second edges by rotational movement; and the third edge of the surface element comprises a second male joining member and the fourth edge comprises a second female joining member, wherein the second male joining member and second female joining member of the surface element are configured such that two of such surface elements at their respective third edge and fourth edge can be interconnected by a downward motion of the third edge of one of the two surface elements with respect to the fourth edge of the other of the two surface elements, to thereby result in a vertical as well as horizontal locking, wherein the second male joining member is formed as an upper cheek protruding at the third edge and provided with a downward directed portion, the upper cheek, inclusive the downward directed portion defining a distal end face, wherein the second female joining member is formed as a lower cheek protruding at the fourth edge and provided with an upward directed portion, wherein the second male joining member comprising a male cheek surface at a lower side of the upper cheek and the second female joining member comprising a female cheek surface at an upper side of the lower cheek, the male and female cheek surfaces arranged to interact with one another so that two joined adjacent floor elements become locked to each other in a horizontal direction, wherein the third and fourth edges each comprising one or more locking surfaces for locking the third edge and a fourth edge of two of such coupled surface elements against vertical separation, wherein all locking surfaces for locking against vertical separation that are present at the third edge are located at the distal end face, and wherein the lower cheek is formed in one piece of the board.

2. The surface element of claim 1, wherein the first male joining member, the first female joining member, the second male joining member and the second female joining member are configured such that the third edge can be joined by the downward movement with the fourth edge of a similar adjacent panel concurrently with the joining of the first edge to the second edge of an adjacent panel by the rotational movement.

3. The surface element of claim 2, wherein the female cheek surface is inclined with respect to the plane of the surface element.

4. The surface element of claim 3, wherein the female cheek surface is upwardly directed from a proximal to a distal position.

5. The surface element of claim 4, wherein the female cheek surface is planar.

6. The surface element of claim 2, wherein the female locking surface is upwardly directed from a proximal to a distal position.

7. The surface element of claim 6, wherein the female locking surface is planar.

8. The surface element of claim 2, wherein the upper cheek, inclusive the male locking surfaces are formed in one piece of the board.

* * * * *

UNITED STATES PATENT AND TRADEMARK OFFICE

CERTIFICATE OF CORRECTION

PATENT NO. : 9,260,869 B2
APPLICATION NO. : 14/098187
DATED : February 16, 2016
INVENTOR(S) : Palsson et al.

It is certified that error appears in the above-identified patent and that said Letters Patent is hereby corrected as shown below:

On the title page, item (63) and in the specification, column 1, line 6, should be corrected as shown below:

Continuation of and claims priority to U.S. Application No. 13/860,315, filed April 10, 2013 which is a continuation of and claims priority to U.S. Application No. 13/437,597, filed April 2, 2012, now U.S. Patent No. 8,544,233, which is a continuation of and claims priority to U.S. Application No. 12/240,739, filed September 29, 2008, now U.S. Patent No. 8,146,318, which is a divisional of and claims priority to U.S. Application No. 11/540,583, filed October 2, 2006, now U.S. Patent No. 7,441,385 which is a continuation of U.S. Application No. 10/286,982, filed November 4, 2002, now U.S. Patent No. 7,121,058 which is a continuation-in-part of U.S. Application No. 09/672,076, filed September 29, 2000, now U.S. Patent No. 6,591,568; U.S. Application No. 09/988,014, filed November 16, 2001; U.S. Application No. 10/242,674, filed September 13, 2002, now U.S. Patent No. 7,332,053.

Signed and Sealed this
Tenth Day of May, 2016

Michelle K. Lee

Michelle K. Lee
*Director of the United States Patent and Trademark Office*